US010342290B2

(12) United States Patent
Brooks

(10) Patent No.: US 10,342,290 B2
(45) Date of Patent: Jul. 9, 2019

(54) MODIFIED SHOE PERMITTING FOREFOOT EXTENSION FOR NATURAL SUPINATION AND PRONATION

(71) Applicant: Kevin Brooks, Westwood, MA (US)

(72) Inventor: Kevin Brooks, Westwood, MA (US)

( * ) Notice: Subject to any disclaimer, the term of this patent is extended or adjusted under 35 U.S.C. 154(b) by 0 days.

(21) Appl. No.: 15/237,630

(22) Filed: Aug. 15, 2016

(65) Prior Publication Data

US 2017/0065023 A1 Mar. 9, 2017

Related U.S. Application Data

(60) Provisional application No. 62/204,496, filed on Aug. 13, 2015.

(51) Int. Cl.

| | |
|---|---|
| ***A43B 13/14*** | (2006.01) |
| ***A43B 7/14*** | (2006.01) |
| ***A43B 7/24*** | (2006.01) |
| ***A43B 13/16*** | (2006.01) |

(52) U.S. Cl.

CPC ..... *A43B 13/141* (2013.01); *A43B 7/141* (2013.01); *A43B 7/24* (2013.01); *A43B 13/16* (2013.01)

(58) Field of Classification Search

CPC ..... A43B 13/141; A43B 13/181; A43B 13/04; A43B 13/187; A43B 13/14

USPC ..... 36/102

See application file for complete search history.

(56) References Cited

U.S. PATENT DOCUMENTS

| | | | | |
|---|---|---|---|---|
| 2,155,166 | A * | 4/1939 | Kraft | A43B 13/223 36/32 R |
| 2,162,912 | A * | 6/1939 | Craver | A43B 13/223 36/59 R |
| 4,667,423 | A * | 5/1987 | Autry | A43B 13/12 36/102 |
| 6,115,945 | A * | 9/2000 | Ellis, III | A43B 13/04 36/102 |
| 7,168,190 | B1 * | 1/2007 | Gillespie | A43B 3/24 36/102 |
| 7,290,357 | B2 | 11/2007 | McDonald et al. | |
| 7,946,058 | B2 * | 5/2011 | Johnson | A43B 3/0057 36/102 |
| 8,505,220 | B2 * | 8/2013 | James | A43B 13/141 36/102 |
| 8,813,394 | B2 * | 8/2014 | Weidman | A43B 5/008 36/100 |
| 8,919,015 | B2 | 12/2014 | Holt et al. | |

(Continued)

*Primary Examiner* — Ted Kavanaugh

(74) *Attorney, Agent, or Firm* — Daniel N. Smith

(57) ABSTRACT

A modified shoe that allows the forefoot to extend, creating an everted forefoot in relation to an inverted heel. This action of the foot creates a higher and contracted medial arch. The force of the first metatarsophalangeal joint and first phalange pushing against the ground tilts the rest of the foot at a slight angle to the lateral side, creating supination. The modified shoe also incorporates a unique process of pre-stretching forefoot flex grooves that will allow for a more efficient hinge at the metatarsophalangeal joints. This allows for the several biomechanical changes to a person's gait pattern. This shoe will allow for people to walk with a more natural gait pattern, and not the gait pattern that many people have adopted due to restrictive footwear. This shoe will be ideal for people with forefoot varus, and will have benefits for people with a neutral foot as well.

4 Claims, 46 Drawing Sheets

(56) References Cited

U.S. PATENT DOCUMENTS

| | | | | |
|---|---|---|---|---|
| 2005/0150134 | A1* | 7/2005 | Issler | A43B 13/141 36/102 |
| 2008/0216355 | A1* | 9/2008 | Becker | A43B 13/026 36/102 |
| 2010/0299965 | A1* | 12/2010 | Avar | A43B 5/06 36/102 |
| 2011/0094125 | A1 | 4/2011 | Weightman | |
| 2013/0000152 | A1* | 1/2013 | Cooper | A43B 1/0072 36/102 |
| 2014/0144049 | A1* | 5/2014 | Ellis | A43B 3/0005 36/103 |
| 2014/0215853 | A1* | 8/2014 | Rushbrook | A43B 5/001 36/102 |
| 2014/0310992 | A1 | 10/2014 | Shalom et al. | |
| 2014/0373396 | A1 | 12/2014 | Chang | |
| 2015/0059215 | A1* | 3/2015 | Burch | A43B 3/128 36/102 |

* cited by examiner

MODIFIED SHOE PERMITTING FOREFOOT EXTENSION FOR NATURAL SUPINATION AND PRONATION

CROSS REFERENCE TO RELATED APPLICATION

This application claims the benefit of U.S. Provisional Patent Application No. 62/204,496, filed on Aug. 13, 2015, the contents of which are incorporated herein by reference.

FIELD OF THE INVENTION

This invention relates to a modified shoe or shoe sole with flexible areas around the metatarsophalangeal joints to allow extension of the forefoot, and rounded bottom sections to allow for natural supination and pronation of the foot.

BACKGROUND OF INVENTION

As illustrated in FIGS. 1-3, the exterior bottom surface of a human foot comprises, from front to back: five toes 1, toe mounds 2, the longitudinal medial (inner) arch 3, the longitudinal lateral (outer) arch 4, and the heel 5. As illustrated in FIGS. 4 and 5, internally, the toes 1 are formed from the phalanges 12; the toes mounds 2 are formed from the first to fifth metatarsal bones 13; the medial arch 3 is formed by the calcaneus 14, the talus 15, the navicular 16, the three cuneiforms 17, and the first, second, and third metatarsals 13; the lateral arch 4 is formed by the calcaneus 14, the cuboid, and the fourth and fifth metatarsals 13; and the heel 5 is formed from the calcaneus 14. The metatarsophalangeal joints (MTP) 18 are the joints where the metatarsals meet the phalanges 12.

The term medial refers to the part of the body closest to the midline of the body. The medial arch 3 refers to the high arch between the inner portion of the heel 5 and the first, or big, toe. The term lateral refers to the part of the body along the outside of the body. The term lateral arch 4 refers to the low arch between the outer portion of the heel 5 and fifth, or pinky, toe.

The MTP joints 18 are hinge joints in the foot. Each metatarsal bone 13 has a different degree of hinge from its respective phalange 12 (toe) when the foot is in a neutral position. The first metatarsal has the highest degree of hinge from the first toe. The fifth metatarsal has the lowest degree of hinge from the fifth toe. As illustrated in FIG. 4, the angle A from the first MTP to the navicular bone 16 (highest point of medial arch) is approximately twenty degrees. As illustrated in FIG. 5, the angle A from the fifth MTP 18 to the base of the fifth metatarsal 13 is less than five degrees.

As illustrated in FIG. 4, the medial arch has multiple angles: The acute angle A from the first MTP 18 to the navicular bone 16 and calcaneus 14, the obtuse angle B from the Navicular bone 16 to the first MTP 18 and calcaneus 14, and the acute angle C from the calcaneus 14 to the Navicular bone 16 and MTP 18.

As illustrated in FIG. 2-7, the foot contains many different types of natural movements. Dorsiflexion and plantar flexion refers to extension or flexion of the foot at the ankle 7. Dorsiflexion 6 is the movement upwards towards the body, where the toes 1 are brought closer to the shin 8. This decreases the angle between the dorsum 9, or upper surface, of the foot and the leg. Plantar flexion is the movement downwards away from the body, which decreases the angle between the sole 10, or bottom surface, of the foot and the back of the leg. The terms forefoot extension and forefoot flexion may be used interchangeably with the forefoot being plantar flexed (plantar flexion=forefoot extension) and dorsi flexed (dorsiflexion=forefoot flexion). As illustrated in FIGS. 6 and 7, when the forefoot 11 is in a position of extension, the forefoot 11 hinges towards the body at the MTP joints 18, and everted in relation to the heel 5/calcaneus 14. As illustrated in FIGS. 4-5, when the forefoot 11 is in a neutral flexion position, the forefoot 11 is un-hinged at the MTP joints 18 and is neutral in relation to the heel 5/calcaneus 14. When the forefoot 11 is in a position of full flexion, the forefoot 11 hinges down away from the body at the MTP joints 18, and inverted in relation to the heel 5/calcaneus 14.

Eversion is the movement of any part of the foot away from the median, or midsagittal, plane. Inversion is the movement of any part of the foot towards the median plane. Eversion and inversion can refer to the forefoot 11, heel 5, and subtalar joint. The subtalar joint (STJ) is the joint at the meeting of the calcaneus 14 and the talus bone 15. The subtalar joint is used to measure the overall angle of the foot in the medical field.

The terms everted and inverted refer to the forefoot 11 and heel 5 positions at a particular point in time, and used in relation from the forefoot 11 to the heel 5. The term everts is used to describe the action of eversion. The term inverts is used to describe the action of inversion.

As illustrated in FIGS. 4-15, movements of the foot are involved in the natural human gait, which is the pattern of movement of the feet during walking or running over a solid surface/ground 19. The human foot acts as a tripod during a normal gait. As illustrated in FIG. 8, there are three points of contact on the bottom surface of the foot as it touches the ground during a normal gait: the first metatarsal point of contact 20, the fifth metatarsal point of contact 21, and the heel point of contact 22. These three points of contact act as a tripod of support.

The heel 5 and subtalar joint maintain similar actions of eversion and inversion throughout a natural human gait pattern. The heel 5 and forefoot 11 have opposite actions of eversion and inversion throughout a natural human gait pattern.

Research has proven that when the forefoot 11 is everting, it directly correlates with the heel 5 inverting. This motion is known as "supination." The same is true of the opposite actions: when the forefoot 11 is inverting, the heel 5 is everting during weight bearing. This motion is known as "pronation." Pronation (eversion) and supination (inversion) refer to the rotation of the foot at the subtalar joint.

The forefoot's actions of eversion and inversion control the action of the heel's inversion and eversion. The forefoot's actions therefore determine the foot's tripod, and the rate of pronation and supination.

The terms varus and valgus are interchangeable with the terms inverted and everted. The terms varus and valgus are typically used to describe the angle of the forefoot 11 and heel 5 in non-weight bearing positions. A forefoot varus position is the inward angulation (inverted) of the forefoot 11 in relation to the subtalar joint and the ground 19. A forefoot valgus position is the outward angulation (everted) of the forefoot 11 in relation to the subtalar joint and the ground 19.

As illustrated in FIGS. 6-7, in non-weight bearing position of the foot, when the forefoot 11 is in extension (plantar flexion of the metatarsophalangeal joints 18 (MTP's), the hinge angle is up to 45 degrees As the forefoot 11 flexes to absorb ground 19 contact, the MTP joints 18 un-hinge. This decreases angles D and E to zero. Angles A and C decrease slightly, and the medial arch 3 is lowered a proper amount to absorb force. As illustrated in FIG. 4, Angle A from the first MTP joint 18 to the Navicular bone 16 and the heel 5/calcaneus 14 determines the height of a person's longitudinal medial arch 3. This angle A varies between approximately 20 and 15 degrees during a normal gait pattern. This allows the medial arch 3 to contract and reach a normal height. As this angle A decreases, Angle C also decreases, and Angle B increases towards 180 degrees. As this occurs, the length between Angles A and C, the longitudinal medial arch 13, increases. As the longitudinal medial arch 13 increases in length, the forefoot's 11 angle of inversion in relation to the heel 5 also increases.

This poor foot position of inverted forefoot, everted heel, and lowered and lengthened medial arch is commonly known as "medial arch collapse" or "flat feet."

There are two main types of gait patterns in a normal foot (a foot without a structural deformity): a proper gait pattern, and a gait pattern with hyper-pronation at the subtalar joint, more commonly known as "over pronation."

A proper gait pattern occurs when the foot experiences a normal, healthy amount of pronation and supination. Depending on the pace of walking, jogging, or running, either the forefoot or heel may be the first point of ground contact in proper gait pattern. In all paces, the heel 5 leaves the ground prior to the forefoot 11, and the toes 1 are the last point of contact to leave the ground 19. In proper gait pattern, the forefoot 11 will be used in controlling the pronation and supination. In proper gait pattern, the forefoot 11 remains on the same plane as the ground 19. Due to the fact that the forefoot 11 remains on the same plane as the ground 19, it gives the appearance that the rearfoot is causing the changes in inversion, eversion, and hinging. In reality, the forces of the forefoot 11 against the ground 19 cause the changes in angles at the MTP's 18 that move the heel 5 and lower leg. Prior to initial ground contact, the forefoot 11 begins in moderate extension, and is moderately hinged and everted in relation to the heel 5. The forefoot 11 goes through flexion by un-hinging, and inversion as a mechanism to absorb ground contact, and stops un-hinging and inverting when it arrives at the same plane as the heel 5. Angles D and E decrease to zero. Angles A and C decrease slightly (less than 5 degrees of change). The forefoot 11 then begins extension by re-hinging and eversion again as a mechanism to push off of the ground 19. Angle D increases at a slightly higher rate than Angle E, causing the heel 5 to be slightly inverted upon push off. Angles A and C increase to their original angles.

From a rear point of view, the heel 5 begins slightly inverted, everts to a neutral position, and then lifts off the ground and inverts moderately as the forefoot 11 pushes off the ground 19. In a proper gait pattern, the forefoot 11 does not become inverted in relation to the heel 5. Therefore, the heel 5 is never everted in relation to the ground. The heel 5 is inverted in non-weight bearing position before and after ground contact, and neutral during weight bearing position. Because the heel 5 is non-weight bearing while inverted, it remains in line with the lower leg. This position is not susceptible to injury, and allows the hips to externally rotate and extend. External hip rotation and hip extension both allow the gluteus muscles to contract.

As illustrated in FIGS. 4-15, a normal, healthy human gait pattern, the proper foot posture is:

1) An initial foot contact having (FIG. 12):
   a) First metatarsophalangeal joint 18 in a moderately plantar-flexed (hinged) position, Angles D and E approximately 15-25 degrees. Angles A and C approximately 20 degrees
   b) Forefoot 11 in an everted angle in relation to the heel 5, and is parallel with the ground 19;
   c) The subtalar joint and heel 5 are inverted to both the ground 19 and the forefoot 11 prior to ground contact.
   d) The heel 5 strikes the ground 19 on the outer (lateral) half due to the inverted position.
2) A loading response having:
   a) Forefoot 11 contacts and absorbs the ground 19, and inverts to a neutral angle in relation to the heel 5.
   b) The MTP's 18 un-hinge: Angles D and E decrease to zero. Angles A and C decrease slightly and remain above 15 degrees.
   c) The heel 5 everts to a neutral position.
   d) The forefoot 11 and heel 5 actions place the foot in a motion of "pronation."
3) A mid-stance having (FIGS. 14-15):
   a) The forefoot 11 in a neutral angle in relation to the heel 5.
   b) The toes 1 contact and push against the ground 19 for stabilization.
   c) The forefoot 11 and heel 5 are both firmly on the ground 19, and on the same plane as the ground (Angles D and E at 0 degrees)
   d) The foot's motion of pronation begins to transition to supination.
4) A terminal stance having:
   a) Forefoot re-extends by hinging at the MTP's 18. Angles D and E increase up to 45 degrees. Angle D is slightly greater than Angle E, causing:
   b) Forefoot 11 eversion to a greater degree of everted position in relation to the heel 5 than the initial contact position, to allow for greater foot push off.
   c) The heel 5 lifting off the ground and inverting in relation to the forefoot 11 and ground 19.
   d) The forefoot 11 and heel 5 actions place the foot in a motion of "supination."
5) A toe off push off position having (FIG. 12-13):
   a) The forefoot 11 and toes 1 pushing off of the ground 19 from an everted position, and on the same plane as the ground 19.
   b) The inverted position of the heel 5 allows the hips to extend and externally rotate. This places the body in a healthy position through swing phase.

As illustrated in FIGS. 16-21, in an improper gait pattern of "over pronation", the forefoot 11 begins slightly extended, with the MTP's 18 slightly hinged and in a neutral or slightly everted position in relation to the heel 5. As the forefoot 11 absorbs ground contact, Angles D and E decrease to 0. Due to inefficient ground absorption, the first MTP 18 continues to un-hinge, causing Angles A and C to decrease significantly. Therefore, the forefoot 11 inverts past a neutral relationship to the heel 5, to a moderately inverted position and the medial arch 3 lengthens and lowers. The forefoot 11 then extends by re-hinging and everts to push off of the ground 19 from a neutral or slightly everted position.

From a rear point of view, the heel 5 begins in a neutral or slightly inverted position. The heel 5 everts to a moderately everted position, and then lifts off the ground 19 in a neutral or slightly inverted position. This places the forefoot 11 in an inverted position and the heel 5 in an everted position during a weight bearing position. Research has proven that an everted heel 5 position during a weight bearing position leads to instability of the foot and leg, and soft tissue injury. The repeated inverted position of the forefoot 11 during a weight bearing position may lead to the soft tissue foot deformity of "forefoot varus."

A varus deformity is the inward angulation of the distal segment of a foot bone in relation to the subtalar joint and ground. A valgus deformity is the opposite, an outward angulation of the distal segment of a foot bone in relation to the subtalar joint. The terms varus and valgus always refer to the direction that the distal segment of the joint points, and are primarily used to describe the angle of the forefoot 11 or heel 5 in a non-weight bearing position.

In a forefoot varus deformity of the foot, also called forefoot supinatus, the first metatarsal 13 angles inward over time due to flexible soft tissue deformity of the foot. Forefoot varus deformity begins with excessive forefoot inversion in the gait pattern. During the loading response and mid-stance positions of an "over pronation" gait pattern, the forefoot 11 is pushed into an inverted (varus) angle in relation to the heel 5. As the forefoot 11 varus condition worsens, the forefoot 11 remains in an inverted position while in a non-weight bearing position. This causes the medial arch 3 to lengthen and have a lower height, and the foot appears to be "flat" during non-weight bearing positions. As illustrated in FIG. 21, this position forms an unstable tripod support due to the everted heel 5 position throughout the gait pattern. At this point, the gait is severely affected as during the initial contact, loading response, mid-stance, terminal stance, and toe push off positions, as the forefoot 11 remains in an inverted (varus) angle in relation to the heel 5. A non-weight bearing forefoot varus of 0 to 4 degrees is considered normal and healthy. A non-weight bearing forefoot varus of 8 degrees or greater has proven to lead to instability and soft tissue injury in the foot and leg.

Forefoot varus causes the bones on the inside edge of the forefoot 11 to sit higher off the ground surface 19 than the outside of the foot during non-weight bearing positions. Thus, in theory (without gravity), only two points of the foot would contact the ground surface: the heel point of contact 22 and the fifth metatarsal point of contact 21. However, in reality, when the foot contacts the ground, there must be a third point, the first metatarsal point of contact 20, in order to balance a person's weight.

There are two ways for a person with forefoot varus to complete the three points 20, 21, and 22 of ground contact. The first way, as what happens in pre-existing shoes, is that the forefoot 11 remains in an inverted relation to the heel 5. Therefore, the entire foot must rotate to the inside in order to contact the ground with three points 20, 21, and 22. In this position, the lateral aspect of the foot does not have the proper amount of weight bearing, the forefoot 11 (first metatarsophalangeal joint in particular) is not extended, and the heel is everted 5. Forefoot varus leads to lengthening the medial arch 3 of the foot, leading to a lower height, and even eventual flattening of this medial arch 3. The combination of an everted heel 5 and an un-extended, inverted forefoot 11 is poor foot positioning. It makes the foot, ankle, and body as a whole susceptible to injury. The everted position of the heel 5 during weight bearing positions lowers the medial arch 3 height excessively, which negatively changes a person's gait pattern, leading to several injuries. The forefoot varus foot type may lead to the following injuries: plantar fasciitis, iliotibial (IT) band syndrome, ACL injuries, medial knee injuries, and Achilles tendonitis. The foot position can also create atrophy in certain muscles, notably the gluteus maximus, gluteus medius, and gastrocnemius. The gluteus muscles are unable to contract due to lack of hip extension and external rotation.

In summary, a foot with a normal forefoot 11 and heel 5 relationship may have a poor "over pronation" gait pattern in which the forefoot 11 is inverted in relation to the heel 5 during weight bearing positions, particularly during the mid-stance. This poor gait pattern leads to injuries, as well as the soft tissue deformity of "forefoot varus." In a forefoot varus foot, the forefoot 11 is inverted in relation to the heel 5 prior to ground contact. Therefore, the everted heel 5 and medial arch 3 height collapse occurs throughout the gait pattern and is more severe. This makes a forefoot varus foot type highly susceptible to the injuries previously listed.

As illustrated in FIGS. 14-19, a foot with a neutral forefoot 11 and heel 5 relationship with an improper gait pattern may "over pronate" due to poor footwear and several other factors. The following gait pattern occurs:

1) An initial foot contact having (FIG. 14):
   a) First metatarsophalangeal joint 18 in a slightly plantar flexed (hinged) position, Angles D and E approximately 15-25 degrees. Angles A and C approximately 20 degrees.
   b) Forefoot 11 in a slightly everted angle, or neutral, in relation to the heel 5, and slightly inverted in relation to the ground 19.
   c) The subtalar joint and heel 5 are slightly inverted, or neutral, in relation to the forefoot 11, and slightly inverted in relation to the ground 19.
   d) Heel 5 strikes the ground 19 on the outer (lateral) half due to the slightly inverted position.
2) A loading response having:
   a) The forefoot 11 contacts and absorbs the ground 19, and inverts past a neutral position to a slightly inverted position in relation to the heel 5, due to instability.
   b) The MTP's 18 unhinge. The first MTP 18 unhinges excessively. Angles D and E decrease to 0. Angles A and C decrease excessively to under 10 degrees.
   c) The heel 5 everts past a neutral position to slightly everted position in relation to the forefoot 11 and ground 19.
   d) The forefoot 11 and heel 5 actions place the foot in a motion of "over pronation."
3) A mid-stance having (FIGS. 18-19):
   a) The forefoot 11 in an inverted angle in relation to the heel 5; the heel 5 in an everted angle while weight bearing.
   b) The toes 1 do not properly push against the ground 19, losing stability.
   c) The forefoot 11 and heel 5 are both on the ground, but without stability. Angles A and C are between 10 and 0 degrees.
   d) The position of inverted forefoot 11 and everted heel 5 lowers and lengthens the medial arch 3, and places the body at a position that is moderately susceptible to injury. In some cases, this repeated position leads to the soft tissue deformity of forefoot varus.
4) A terminal stance having:
   a) Forefoot re-extends by hinging at the MTP's 18. Angles D and E increase moderately, to less than 45 degrees. Angles A and C return to approximately 15 degrees.
   b) Forefoot 11 everts to a slight degree of everted position in relation to the heel 5.

c) The heel 5 lifting off the ground 19 and inverts to a position of slightly inverted in relation to the forefoot 11 and ground 19.

d) The forefoot 11 and heel 5 actions place the foot is in a motion of "supination".

5) A toe push off position having:

a) The forefoot 11 pushing off of the ground 19 from a slightly everted position, and on the same plane as the ground 19.

b) The slightly inverted position of the heel 5 allows the hips to slightly extend and externally rotate.

As illustrated in FIGS. 18-21, an "over pronation" gait pattern may lead to the soft tissue foot deformity of "forefoot varus." A foot with a soft tissue deformity of forefoot varus in non-weight bearing positions has an improper gait pattern that is highly susceptible to injury:

1) An initial foot contact having (FIG. 18):

a) First metatarsophalangeal joint 18 in a neutral position, the MTP joints 18 are already un-hinged. Angles D and E are less than 15 degrees. Angles A and C are less than 10 degrees b) Forefoot 11 in an inverted angle ("varus") in relation to the heel 5.

c) The subtalar joint and heel 5 are everted in relation to the forefoot 11 prior to ground contact.

d) The heel 5 strikes the ground on the inner (medial) half due to the everted position.

2) A loading response having:

a) The forefoot 11 contacts and inefficiently absorbs the ground 19, and inverts excessively.

b) The MTP's 18 unhinge. The first MTP 18 unhinges excessively. Angles D and E decrease to 0. Angles A and C decrease to 0 degrees.

c) The heel everts excessively.

d) The forefoot 11 and heel 5 actions place the foot in a motion of extreme "over pronation."

3) A mid-stance having (FIG. 19):

a) The forefoot 11 in a position of extremely inverted in relation to the heel 5.

b) The toes 1 do not absorb the ground 19 or add any stabilization to the foot.

c) The heel 5 in a position of extremely everted in relation to the forefoot 11 and the ground. Angles A and C are at 0 degrees, and the medial arch 3 lengthens and lowers to the ground 19.

d) The foot's motion of extreme over pronation flattens the height of the medial arch 3 and places the foot and body in a position that is unstable and highly susceptible to injury.

4) A terminal stance having:

a) Forefoot re-extends by hinging at the MTP's 18. Angles D and E increase slightly, to approximately 15 degrees. Angles A and C return to under 10 degrees.

b) Forefoot 11 is not able to evert back to neutral, and is in a position of slightly inverted in relation to the heel 5.

c) The heel 5 does not lift off the ground 19, is not able to invert to neutral, and is in a position of slightly everted in relation to the forefoot 11 and the ground.

d) The forefoot 11 and heel 5 actions do not allow the foot to properly supinate.

5) A toe push off position having:

a) The foot pushing off the ground 19 all at once in an inefficient and injury susceptible position.

b) The everted position of the heel 5 forces the hips to flex and internally rotate during the swing phase, making the leg susceptible to further injury.

The current structure of most commercially available shoes increases the progression and angle of forefoot varus by restricting the forefoot 11. Most shoes force a person into an "over pronation" gait pattern rather than a proper gait pattern. The over pronation gait pattern leads to forefoot varus in a percentage of people with a neutral foot, and increases the angle of inverted (varus) forefoot in people who have already developed forefoot varus.

There are two main components of shoe manufacturing. The first component is the last. A last is a mechanical form that has a shape similar to that of a human foot. It is used by shoemakers in the manufacture and repair of shoes. A last is made of high density plastic, and is designed to give the shoe its desired shape. Both the "upper" and the sole are attached to the last in the manufacturing process. The last determines aspects such as the general shape, forefoot width, heel height, and toe spring. The second main component is the outsole mold. The mold is based off of technical engineering drawings of the outsole. The mold determines aspects such as the thickness of the outsole, the contour, and the depth of flex grooves. The toe spring in most commercial running shoes is created with a small toe spring in the last, combined with tapering of outsole towards the toe. The tapering is designed so that the thickness of the outsole is less at the tip of the toe than it is under the MTP joints. This design allows the foot to roll forward and off the toe when walking or running. In the manufacturing of most commercial shoes, the mold is created to match the contour of the last. For example, a last with a ten degree toe spring will have an outsole with a 10 degree toe spring, In most shoes, the forefoot 11 and heel 5 are on the same plane. This does not allow the forefoot 11 to extend and create an everted plane in relation to the heel 5. Because the forefoot 11 must invert as a mechanism to absorb contact (pronation), the forefoot 11 inverts from a neutral position to an inverted position inside the shoe. This causes the heel 5 to begin in neutral and evert to an everted position inside the shoe, lowering the medial arch 3 excessively.

In most running shoes, the forefoot is gradually contoured from the rearfoot to raise up approximately 15 degrees in the forefoot. In some running shoes, the forefoot contains flex grooves, designed to allow the forefoot to hinge from the rearfoot This hinge is known as "toe spring." In these shoes, flex grooves are closed in non-weight bearing positions of the shoe. The flex grooves open with external pressure, but are difficult to open with the internal pressure of the foot. Thus, previous shoes with flex grooves do not allow the forefoot to extend fully (hinge and evert) prior to initial contact. Further, when the flex grooves are closed, the sole still contours to force the forefoot up in a slight hinge of approximately 15 degrees. Thus, previous shoes with flex grooves do not allow the forefoot to un-hinge to zero degrees with the internal pressure of the foot, as in mid stance and static standing. Overall, most running shoes encourage the foot to remain in a slightly extended position throughout gait pattern. The inadequate ability of the running shoe to get to an unhinged mid stance position causes instability in the loading response and mid stance that may lead to an "over pronation" gait pattern.

In some models of basketball, cross training, dance, minimal, and other athletic shoes, the sole is significantly flatter compared to running shoes, and contours the forefoot up from the rearfoot at approximately five degrees. This allows the foot to obtain an un-hinged accurate mid stance and static standing foot position. The shoe is able to be hinged with external pressure, but not with the internal pressure of the foot. Therefore, these shoes do not allow the forefoot to extend (hinge and evert) in non-weight bearing. Thus, these shoes do not allow the proper foot position of moderately extended (hinged and everted) forefoot prior to initial contact, and restricts the foot from fully re-extending in terminal stance. This causes instability during initial contact and loading response that leads to poor foot posture during mid stance and an "over pronation" gait pattern, and does not allow for a proper push off.

In most shoes, the outsole heel is flat and parallel with the ground surface. This encourages the foot to contact the ground surface all at once in a neutral position. Due to natural forefoot inversion and heel eversion during loading response, a neutral starting point in gait pattern leads to an inverted forefoot and everted heel position during loading response and mid stance.

Many commercially available shoes disclose a "heel to toe drop" which there is more cushion in the heel than in the forefoot, and toe boxes, which are raised off of the ground to simulate the position of toe push off in terminal stance. The toes are an important part of foot stabilization during mid stance, but are not allowed to contact the ground during mid stance in most shoes. The combination of the heel to toe drop and the toes not engaged with the ground places the body's weight excessively onto a person's heel 5 and midfoot while standing. As stated in the normal gait cycle, when the weight of a person is placed on the forefoot 11, the MTP's un-hinge to absorb the ground and the body's weight. Because the heel 5 is higher off the ground than the forefoot, Angles D and E do not decrease to 0, and the forefoot cannot not absorb the proper amount of ground contact. The forefoot attempts to absorb additional ground contact by continuing to un-hinge at the first MTP (Angles A and C decrease). This causes the forefoot to invert excessively, and the medial arch to lengthen and lower. Thus, most shoes encourage the foot to be in an inverted forefoot 11 and everted heel 5 position while standing and during activities.

Most shoes have a wide configuration at the heel and forefoot, but narrow configuration at the midfoot, which does not match the general straight shape of feet from the outside of the heel to the outside of the forefoot. This shoe configuration squeezes in the lateral arch 4 of the midfoot during movement. A person that walks inside a shoe that "squeezes" the outside of their midfoot does not have a natural gait pattern. In shoes with a "squeezed" midfoot, the base of the fifth metatarsal is not allowed to directly push against the ground to add stability. Instead, the foot lands on the heel 5 and is forced to land in the middle of the midfoot, rather than the lateral side of the midfoot. Because of the natural pronation (forefoot inversion heel eversion) during loading response, any instability to the foot during loading response results in over pronation.

Shoes disclosed in the prior art have attempted to correct "over pronation" gait pattern with a wedge on the medial side of the heel and midfoot to assist people making initial contact with their heel inverted rather than everted. The forefoot's actions and proper engagement with the ground control the heel's eversion to a neutral position; therefore, this wedge does not allow a person to properly strengthen their foot; it merely treats the symptoms of poor foot positioning of everted heel and lowered medial arch. Because a person's heel is rounded and the forefoot is allowed to be inverted inside shoes, poor foot positioning can still occur despite a medial wedge designed to prevent everted heel position and medial arch collapse. This design does not address the underlying problem of a forefoot that is not controlling the heel's eversion due to insufficient ground engagement.

Another previously disclosed method to treat over pronation is to create custom orthotics designed to fit inside of shoes. Custom orthotics are generally made of a hard material, and are designed to support the medial arch to keep it from collapsing. Similar to a heel wedge, custom orthotics are designed to prevent the everted position that occurs in the heel and midfoot during mid stance of an over pronation gait pattern. Again, custom orthotics do not allow a person to properly strengthen their foot; it merely treats the symptoms of poor foot positioning at the heel and midfoot. Furthermore, custom orthotics are expensive and time consuming as they must be prescribed, measured, and made to specifications by medical professionals. Even with prescription custom orthotics, a person cannot maintain a natural gait pattern and fully develop their muscles. This is due to the fact that the base of the first metatarsal, cuneiform bones, and navicular bones are not designed to be weight bearing. These bones pushing down against a hard orthotic may cause deformity that leads to forefoot varus. In addition, the medial arch naturally raises and lowers during gait pattern. A custom orthotic attempts to keep the medial arch at a fixed percentage throughout gait pattern. Stress on joints will continue to occur if the orthotic is placed into an improper shoe.

Prior art designed to correct forefoot varus is to place a wedge under medial side of the forefoot. This design "brings the ground up to the forefoot varus" rather than allowing the forefoot varus to rotate to the ground. This design has not been widely implemented in shoes or orthotic design. The problem with this design is that forefoot varus is an acquired soft tissue deformity, not a bone structure deformity (except in rare cases). A medial forefoot wedge restricts the forefoot from extending and everting, and therefore does not allow a natural and proper gait pattern. The pressure from this wedge under the first metatarsophalangeal joint may further invert the forefoot and cause a higher degree of forefoot varus.

Pre-existing minimal-style barefoot running shoes have attempted to create a more natural gait pattern, but do not compensate for the condition of forefoot varus. While barefoot running shoes incorporated greater flexibility throughout the shoe, they have not specifically designed the forefoot to extend and evert in relation to the heel. Pre-existing minimal and barefoot running shoes eliminated the "heel to toe drop" of "support" shoes. In doing so, these shoes also eliminated the contour of the foot during non-weight bearing, in which an extended forefoot is on a plane closer to the ground than the heel. This places too much pressure on the metatarsal side of the metatarsophalangeal joints. This pressure may cause the forefoot to flex excessively and invert to relieve the pressure. The flat bottom shape of the minimal shoes therefore causes the foot be in a flat position.

Barefoot activities, such as standing, walking, running, sports, and weight training may allow a person to strengthen certain muscles, take pressure off of certain joints and smaller muscles, and ultimately reduce the amount of "overuse" injuries that occur to the average person. However, many people have poor, unnatural foot positioning during these activities due to a lifetime of poorly designed footwear. This poor foot positioning over a lifetime has created weakness and imbalances in the hips and legs, which can't be easily corrected by engaging in barefoot activities.

Various techniques have been developed to counteract the forefoot varus condition, and the problem of an everted heel in weight bearing. As illustrated in FIG. 22, short foot exercises can treat forefoot varus by shortening 23 the medial side 3 of the foot, thus raising and contracting the medial arch (increasing angles A and C). Further, it changes the forefoot 11 from an inverted position to a neutral position. This allows the heel 5 to change from an everted position to a neutral position. Because the lateral side 4 of the foot is not effected by the short foot exercises, this changes the foot from a position of inverted forefoot and everted heel (over-pronation), and places it in a neutral position.

Accordingly, the subject invention is footwear that substantially mimics barefoot activities, to allow a person to stand, walk, and run naturally as if they were barefoot, and compensates or trains foot muscles to reduce or eliminate the excessive over pronation often seen with forefoot varus.

The subject footwear will permit a person's heel to land naturally during activities. The footwear will permit a person's midfoot to strike along the lateral edge (keeping the medial inner arch off of the ground) during the gait cycle. The footwear will permit the first metatarsophalangeal joint room within the shoe to be extended (plantar flexed, hinged) and forefoot everted in relation to the heel, and allow room in the toe box for less restriction. The toe box will be able to be in full contact with the ground while the rest of the shoe is on the ground as well. The modified shoe is designed to allow for a proper gait pattern by allowing the forefoot to extend and flex, and create both an everted forefoot and neutral forefoot in relation to the heel. The design of the modified shoe will distribute a person's weight across the heel, lateral midfoot, forefoot, and toe box. The footwear will contain a strap emulating a Navicular sling wrap, which will be the shoe's form of medial arch support. The footwear will contain deep pre-stretched flex grooves underneath the MTP joints with a rounded heel and lateral midfoot. The lack of sole material under the medial arch along with the flexibility in the forefoot will allow the extension (hinging and everted plane) of the forefoot that will not force the foot into a singular plane during the gait cycle.

SUMMARY OF THE INVENTION

There are additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

The subject invention discloses a modified shoe comprising: a sole, wherein the sole comprises a substantially flat piece comprising a heel portion, a midfoot portion, a forefoot portion, a toe box portion, a plurality of connection sections, wherein each connection section is composed of an elastic compressible material, wherein each connection section further comprises a pre-stretched flexible groove; and further each portion is separated by one of the connection sections between each of the portions such that the heel portion, the midfoot portion, the forefoot portion, and the toe box portion are independently flexible and movable from each other on a horizontal plane, simultaneously, during a natural human gait movement.

The subject invention discloses a modified shoe comprising: a sole, wherein the sole comprises a substantially flat piece comprising a heel portion, a midfoot portion, a forefoot portion, a toe box portion, a plurality of connection sections, wherein each connection section is composed of an elastic compressible material, wherein each connection section further comprises a pre-stretched flexible groove; further wherein each portion is separated by one of the connection sections between each of the portions such that the heel portion, the midfoot portion, the forefoot portion, and the toe box portion are independently flexible and movable from each other on a horizontal plane, simultaneously, during a natural human gait movement; and further wherein during the natural human gait movement, the shoe permits a wearer's foot to land in the middle to lateral side of the heel portion of the sole in an inverted heel position, wherein the forefoot portion of the sole inverts and flexes upward to a neutral relation with the heel portion of the sole and with the toe box of the sole coming in contact with the ground, the forefoot portion of the sole everts again while maintaining ground contact as the heel portion of the sole lifts off the ground and inverts.

The subject invention discloses a modified shoe comprising: an outsole, wherein the outsole comprises a substantially flat piece comprising independent flexible and movable heel, midfoot, forefoot, and toe box portions, wherein the outsole further comprises up to six internal cushioning pads, with one pad in the toe box portion, one pad in the heel portion, three pads in the forefoot portion, and one pad in the midfoot portion, wherein each pad moves and flexes relatively independent of each other; and an insole, wherein the insole comprises a substantially flat piece comprising independent flexible and movable heel, midfoot, forefoot, and toe box portions, wherein the insole further comprises up to six internal cushioning pads, with one pad in the toe box portion, one pad in the heel portion, three pads in the forefoot portion, and one pad in the midfoot portion, wherein each pad moves and flexes relatively independent of each other.

The subject invention discloses a modified shoe comprising: an outsole, wherein the outsole comprises a first substantially flat piece comprising independent flexible and movable first heel, first midfoot, first forefoot, and first toe box portions, wherein the outsole further comprises a first plurality of internal cushioning pads, with a first pad in the toe box portion, a second pad in the heel portion, a third, fourth, and fifth pads in the forefoot portion, and a sixth pad in the midfoot portion, wherein each pad moves and flexes relatively independent of each other; and an insole, wherein the insole comprises a second substantially flat piece comprising independent flexible and movable second heel, second midfoot, second forefoot, and second toe box portions, wherein the insole further comprises a second plurality of internal cushioning pads, with a seventh pad in the toe box portion, an eighth pad in the heel portion, a ninth, tenth, and eleventh pads in the forefoot portion, and a twelfth pad in the midfoot portion, wherein each pad moves and flexes relatively independent of each other.

The subject invention discloses a modified shoe comprising: an outsole, wherein the outsole comprises a first substantially flat piece comprising independent flexible and movable first heel, first midfoot, first forefoot, and first toe box portions, wherein the outsole further comprises a first plurality of internal cushioning pads, wherein each pad moves and flexes relatively independent of each other, further wherein the outsole may confirm to multiple planes simultaneously; and an insole, wherein the insole comprises a second substantially flat piece comprising independent flexible and movable second heel, second midfoot, second forefoot, and second toe box portions, wherein the insole further comprises a second plurality of internal cushioning pads, wherein each pad moves and flexes relatively independent of each other, further wherein the insole may conform to multiple planes simultaneously.

The subject invention discloses a modified shoe for preventing forefoot varus and forefoot valgus positions during a human gait movement, the shoe comprising: an outsole, wherein the outsole comprises a substantially flat piece comprising independent flexible and movable heel, midfoot, forefoot, and toe box portions; an insole, wherein the insole comprises a substantially flat piece comprising independent flexible and movable heel, midfoot, forefoot, and toe box portions; and six internal cushioning pads between the insole and the outsole, with one pad in the toe box portion, one pad in the heel portion, three pads in the forefoot portion, and one pad in the midfoot portion, wherein each pad moves and flexes relatively independent of each other.

The subject invention discloses a modified shoe for preventing forefoot varus and forefoot valgus positions during a human gait movement, the shoe comprising: an outsole, wherein the outsole comprises a substantially flat piece comprising independent flexible and movable heel, midfoot, forefoot, and toe box portions; an insole, wherein the insole comprises a substantially flat piece comprising independent flexible and movable heel, midfoot, forefoot, and toe box portions; and six internal cushioning pads between the insole and the outsole, with a first pad in the toe box portion, a second pad in the heel portion, a third, fourth, and fifth pads in the forefoot portion, and a sixth pad in the midfoot portion, wherein each pad moves and flexes relatively independent of each other.

The subject invention discloses a modified shoe for preventing forefoot varus and forefoot valgus positions during a human gait movement, the shoe comprising: an outsole, wherein the outsole comprises a substantially flat piece comprising independent flexible and movable heel, midfoot, forefoot, and toe box portions; an insole, wherein the insole comprises a substantially flat piece comprising independent flexible and movable heel, midfoot, forefoot, and toe box portions; a plurality of cushioning pads between the insole and the outsole, wherein each pad moves and flexes relatively independent of each other; and wherein the insole and the outsole may conform to multiple planes simultaneously.

The subject invention discloses a modified shoe comprising: an outsole, wherein the outsole comprises a substantially flat piece comprising: a) a heel portion comprising a substantially rounded heel bottom, a heel medial side, a heel lateral side, and a heel center portion, wherein the heel medial and lateral sides raise up gradually to contour a wearer's heel; b) a midfoot portion comprising a substantially rounded midfoot bottom, a medial arch portion, a lateral arch portion, and a center midfoot portion, wherein the medial arch and lateral arch portions raise up to contour the wearer's midfoot, wherein the modified midfoot permits the wearer to land on the lateral arch portion at a variety of angles with the ground surface during a natural human gait movement; and c) a forefoot portion comprising a substantially rounded medial forefoot portion, central forefoot portion, and lateral forefoot portion, wherein the forefoot portion comprises four major flexible points, a first horizontal flexible point located between the midfoot and forefoot portions, a second horizontal flexible point located between the forefoot and toe box portions, a first vertical flexible point located between the lateral and central sections of the forefoot, and a second vertical flexible point located between the medial and central sections of the forefoot; wherein the outsole further comprises up to six internal cushioning pads, with one pad in the toe box portion, one pad in the heel portion, three pads in the forefoot portion, and one pad in the midfoot portion, wherein each pad moves and flexes relatively independent of each other; and an insole, wherein the insole comprises a substantially flat piece comprising: a) a heel portion comprising a substantially rounded heel bottom, a heel medial side, a heel lateral side, and a heel center portion, wherein the heel medial and lateral sides raise up gradually to contour a wearer's heel; b) a midfoot portion comprising a substantially rounded midfoot bottom, a medial arch portion, a lateral arch portion, and a center midfoot portion, wherein the medial arch and lateral arch portions raise up to contour the wearer's midfoot, wherein the modified midfoot permits the wearer to land on the lateral arch portion at a variety of angles with the ground surface during a natural human gait movement; and c) a forefoot portion comprising a substantially rounded medial forefoot portion, central forefoot portion, and lateral forefoot portion, wherein the forefoot portion comprises four major flexible points, a first horizontal flexible point located between the midfoot and forefoot portions, a second horizontal flexible point located between the forefoot and toe box portions, a first vertical flexible point located between the lateral and central sections of the forefoot, and a second vertical flexible point located between the medial and central sections of the forefoot; wherein the insole further comprises up to six internal cushioning pads, with one pad in the toe box portion, one pad in the heel portion, three pads in the forefoot portion, and one pad in the midfoot portion, wherein each pad moves and flexes relatively independent of each other.

The subject invention discloses a modified shoe comprising: an outsole, wherein the outsole comprises a substantially flat piece comprising independent flexible and movable heel, midfoot, forefoot, and toe box portions, wherein the outsole further comprises up to six internal cushioning pads, with one pad in the toe box portion, one pad in the heel portion, three pads in the forefoot portion, and one pad in the midfoot portion, wherein each pad moves and flexes relatively independent of each other; an insole, wherein the insole comprises a substantially flat piece comprising independent flexible and movable heel, midfoot, forefoot, and toe box portions, wherein the insole further comprises up to six internal cushioning pads, with one pad in the toe box portion, one pad in the heel portion, three pads in the forefoot portion, and one pad in the midfoot portion, wherein each pad moves and flexes relatively independent of each other; wherein, during a natural human gait movement, the shoe permits a wearer's foot to land in the middle to lateral side of the heel portion of the outsole in an inverted heel position, wherein the forefoot portion of the outsole inverts and flexes upward to a neutral relation with the heel portion of the outsole, and with the toe box of the outsole coming in contact with the ground, the forefoot portion of the outsole everts again while maintaining ground contact as the heel portion of the outsole lifts off the ground and inverts.

The subject invention discloses a modified shoe comprising: an outsole, wherein the outsole comprises a first substantially flat piece comprising independent flexible and movable first heel, first midfoot, first forefoot, and first toe box portions, wherein the outsole further comprises a first plurality of internal cushioning pads, with a first pad in the toe box portion, a second pad in the heel portion, a third, fourth, and fifth pads in the forefoot portion, and a sixth pad in the midfoot portion, wherein each pad moves and flexes relatively independent of each other; and an insole, wherein the insole comprises a second substantially flat piece comprising independent flexible and movable second heel, second midfoot, second forefoot, and second toe box portions, wherein the insole further comprises a second plurality of internal cushioning pads, with a seventh pad in the toe box portion, an eighth pad in the heel portion, a ninth, tenth, and eleventh pads in the forefoot portion, and a twelfth pad in the midfoot portion, wherein each pad moves and flexes relatively independent of each other; wherein, during a natural human gait movement, the shoe permits a wearer's foot to land in the middle to lateral side of the heel portion of the outsole in an inverted heel position, wherein the forefoot portion of the outsole inverts and flexes upward to a neutral relation with the heel portion of the outsole, and with the toe box of the outsole coming in contact with the ground, the forefoot portion of the outsole everts again while maintaining ground contact as the heel portion of the outsole lifts off the ground and inverts.

The subject invention discloses a modified shoe comprising: an outsole, wherein the outsole comprises a substantially flat piece comprising: a) a heel portion comprising a substantially rounded heel bottom, a heel medial side, a heel lateral side, and a heel center portion, wherein the heel medial and lateral sides raise up gradually to contour a wearer's heel; b) a midfoot portion comprising a substantially rounded midfoot bottom, a medial arch portion, a lateral arch portion, and a center midfoot portion, wherein the medial arch and lateral arch portions raise up to contour the wearer's midfoot, wherein the modified midfoot permits the wearer to land on the lateral arch portion at a variety of angles with the ground surface during a natural human gait movement; and c) a forefoot portion comprising a substantially rounded medial forefoot portion, central forefoot portion, and lateral forefoot portion, wherein the forefoot portion comprises four major flexible points, a first horizontal flexible point located between the midfoot and forefoot portions, a second horizontal flexible point located between the forefoot and toe box portions, a first vertical flexible point located between the lateral and central sections of the forefoot, and a second vertical flexible point located between the medial and central sections of the forefoot; wherein the outsole further comprises up to six internal cushioning pads, with one pad in the toe box portion, one pad in the heel portion, three pads in the forefoot portion, and one pad in the midfoot portion, wherein each pad moves and flexes relatively independent of each other; an insole, wherein the insole comprises a substantially flat piece comprising: a) a heel portion comprising a substantially rounded heel bottom, a heel medial side, a heel lateral side, and a heel center portion, wherein the heel medial and lateral sides raise up gradually to contour a wearer's heel; b) a midfoot portion comprising a substantially rounded midfoot bottom, a medial arch portion, a lateral arch portion, and a center midfoot portion, wherein the medial arch and lateral arch portions raise up to contour the wearer's midfoot, wherein the modified midfoot permits the wearer to land on the lateral arch portion at a variety of angles with the ground surface during a natural human gait movement; and c) a forefoot portion comprising a substantially rounded medial forefoot portion, central forefoot portion, and lateral forefoot portion, wherein the forefoot portion comprises four major flexible points, a first horizontal flexible point located between the midfoot and forefoot portions, a second horizontal flexible point located between the forefoot and toe box portions, a first vertical flexible point located between the lateral and central sections of the forefoot, and a second vertical flexible point located between the medial and central sections of the forefoot; wherein the insole further comprises up to six internal cushioning pads, with one pad in the toe box portion, one pad in the heel portion, three pads in the forefoot portion, and one pad in the midfoot portion, wherein each pad moves and flexes relatively independent of each other; wherein, during a natural human gait movement, the shoe permits a wearer's foot to land in the middle to lateral side of the heel portion of the outsole in an inverted heel position, wherein the forefoot portion of the outsole inverts and flexes upward to a neutral relation with the heel portion of the outsole, and with the toe box of the outsole coming in contact with the ground, the forefoot portion of the outsole everts again while maintaining ground contact as the heel portion of the outsole lifts off the ground and inverts.

In further embodiments of the subject invention, the outsole comprises firm rubber or plastic. In further embodiments of the subject invention, the insole comprises firm rubber or plastic. In further embodiments of the subject invention, the six pads substantially same height for the heel, midfoot, fore foot, and toe box portions of the outsole. In further embodiments of the subject invention, the six cushioning pads of the outsole will be substantially aligned with the six cushioning pads of the insole.

In further embodiments of the subject invention, the modified heel has a uniform thickness. In further embodiments of the subject invention, the medial and lateral side of the modified heel each raise up to a maximum of 10 degree difference from a center portion. In further embodiments of the subject invention, the modified heel permits a wearer to land on both the central portion and the lateral portion of the heel at an angle with the ground surface of 0 to 10 degrees during a natural human gait movement. In further embodiments of the subject invention, the modified heel permits wearer heel contact with the ground surface at an angle that varies in a wearer's left foot and right foot during a natural human gait movement.

In further embodiments of the subject invention, the modified midfoot permits a wearer to land on the lateral arch portion at an angle with the ground surface of 0 to 10 degrees during a natural human gait movement. In further embodiments of the subject invention, the modified midfoot a wearer to land on the lateral arch portion at an angle that varies in a wearer's left foot and right foot during a natural human gait movement. In further embodiments of the subject invention, the modified forefoot permits a wearer to land on the fifth metatarsal at an angle with the ground surface of 0 to 10 degrees during a natural human gait movement.

In further embodiments of the subject invention, the modified forefoot permits a wearer to land on the fifth metatarsal with the ground surface at an angle that varies in a wearer's left foot and right foot during a natural human gait movement.

Further embodiments of the subject invention includes a strap from the center portion of the midfoot outsole, horizontally across a wearer's medial arch, up a medial side of the shoe and connecting on a top exterior of the shoe.

In further embodiments of the subject invention, the forefoot and midfoot portions of the insole and the outsole permit the shoe to flex on two separate vertical and horizontal planes, simultaneously, during a natural human gait movement. In further embodiments of the subject invention, the forefoot and midfoot portions of the insole and the outsole permit the shoe to flex on separate horizontal planes from fifteen degrees everted to five degrees inverted, simultaneously, during a natural human gait movement.

In further embodiments of the subject invention, the insole and outsole do not comprise padding under a medial arch of a wearer.

In further embodiments of the subject invention, the shoe does not compress the outside of a wearer's midfoot.

In further embodiments of the subject invention, the lateral arch of the midfoot portion of the outsole touches the ground as the heel portion is compressed by a wearer's weight during a natural human gait movement. In further embodiments of the subject invention, the lateral arch of the midfoot portion of the outsole will only be weight bearing if both the heel and forefoot portions of the outsole are also weight bearing during a natural human gait movement.

In embodiments of the subject invention, the term "substantially" is defined as at least close to (and can include) a given value or state, as understood by a person of ordinary skill in the art. In one embodiment, the term "substantially" refers to ranges within 10%, preferably within 5%, more preferably within 1%, and most preferably within 0.1% of the given value or state being specified.

In embodiments of the subject invention, the term "relatively" is defined as a comparison of a property, or the proportion of a property between two components, the property herein being the deformability between the apex and the legs of the clip.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto. These together with other objects of the invention, along with the various features of novelty, which characterize the invention, are pointed out with particularity in the claims annexed to and forming a part of this disclosure.

BRIEF DESCRIPTION OF THE DRAWINGS

Advantages of the present invention will be apparent from the following detailed description of embodiments thereof, which description should be considered in conjunction with the accompanying drawings, in which.

DETAILED DESCRIPTION OF THE EMBODIMENTS

Figure 1:
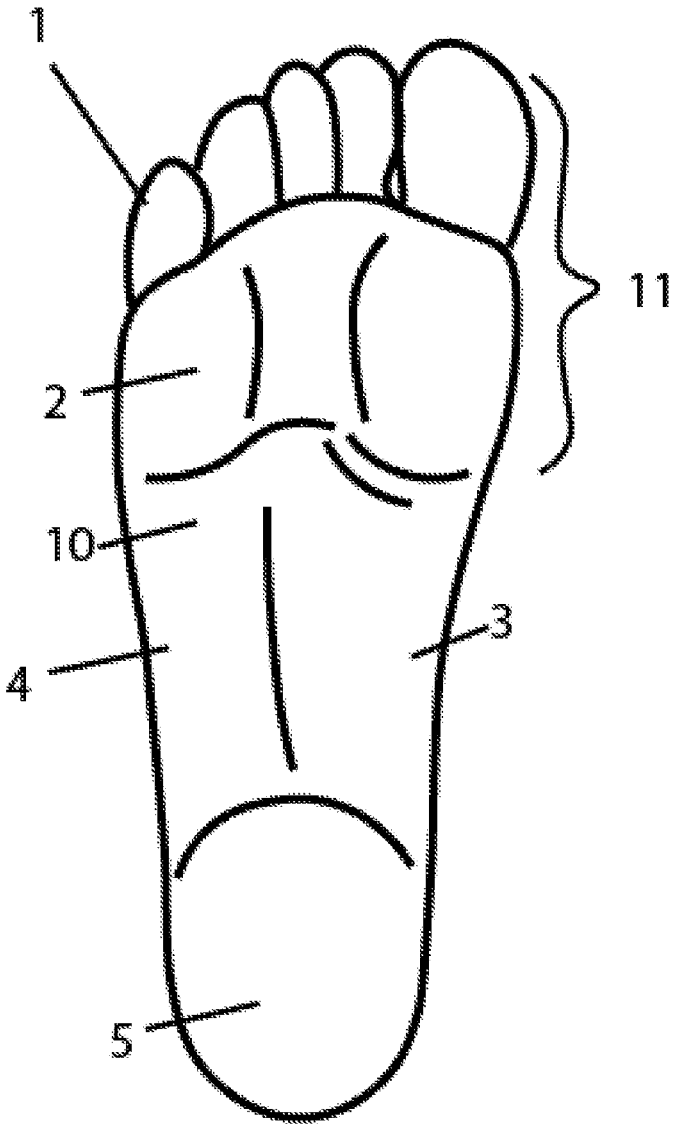
FIG. 1 illustrates a bottom view of a normal right foot with the first metatarsophalangeal joint, the medial arch, and the foot in general in a neutral position.
Figure 2:
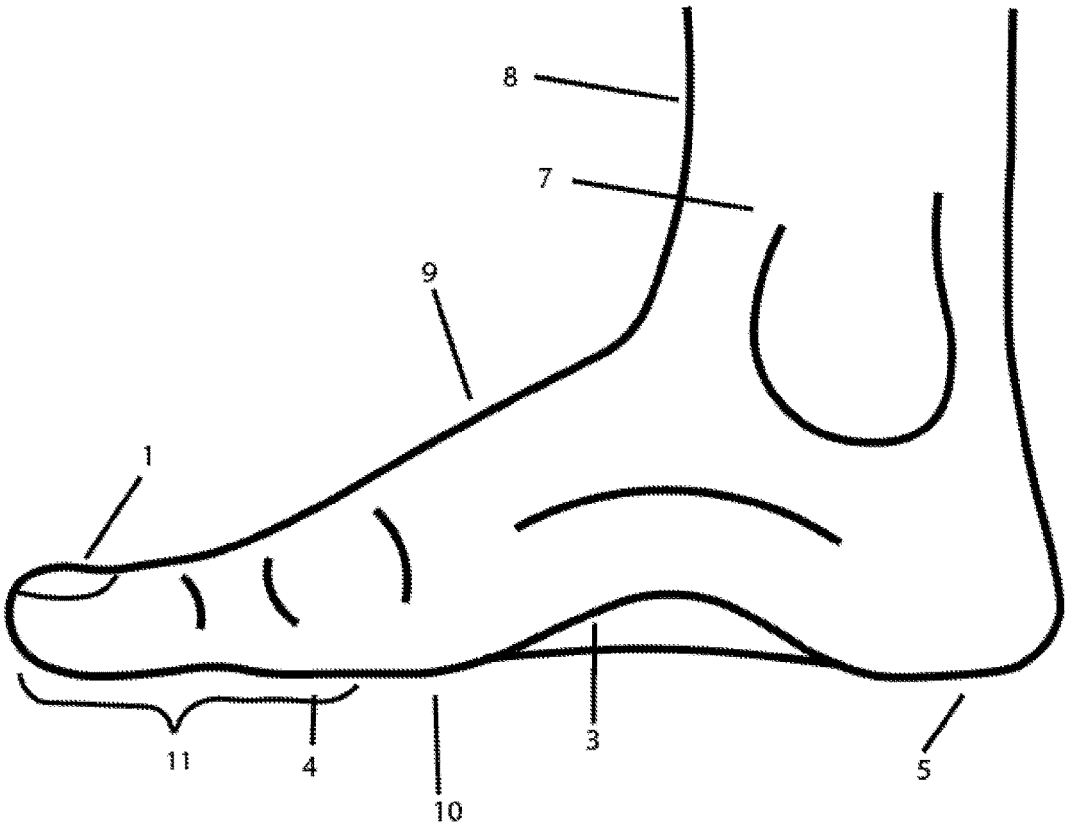
FIG. 2 illustrates a medial side view of a normal right foot with the first metatarsophalangeal joint, the medial arch, and the foot in general in a neutral position.
Figure 3:
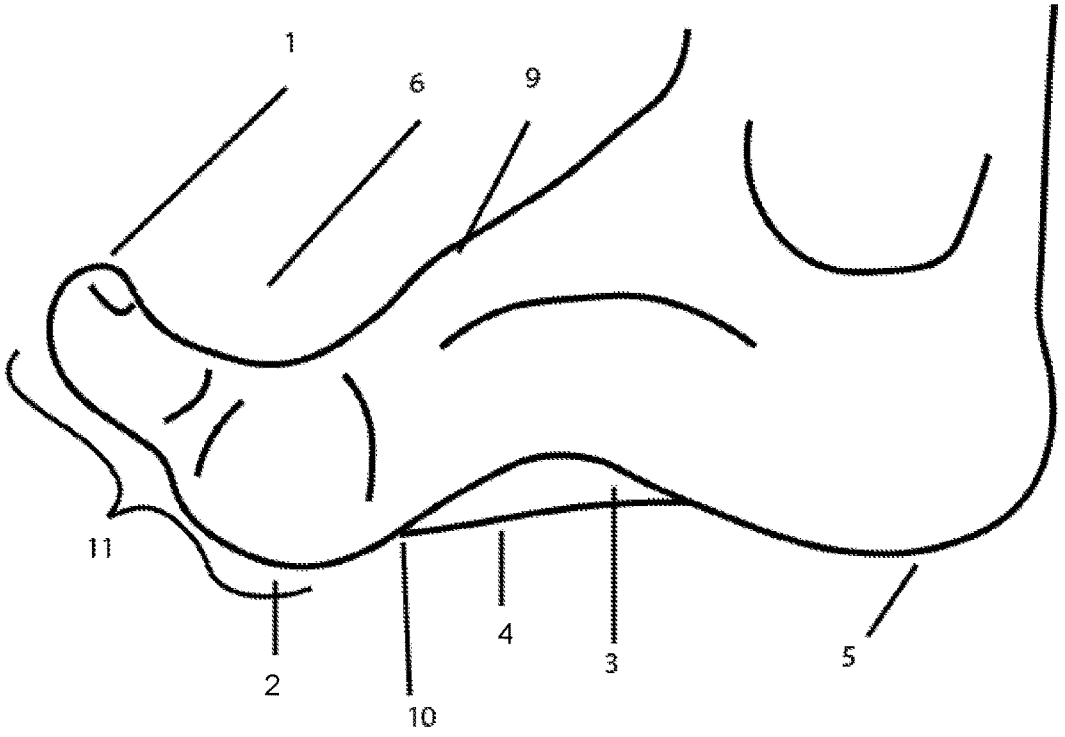
FIG. 3 illustrates a medial side view of a normal right foot with the first metatarsophalangeal joint plantar flexed, placing the forefoot in extension, which contracts and raises the medial arch.
Figure 4:
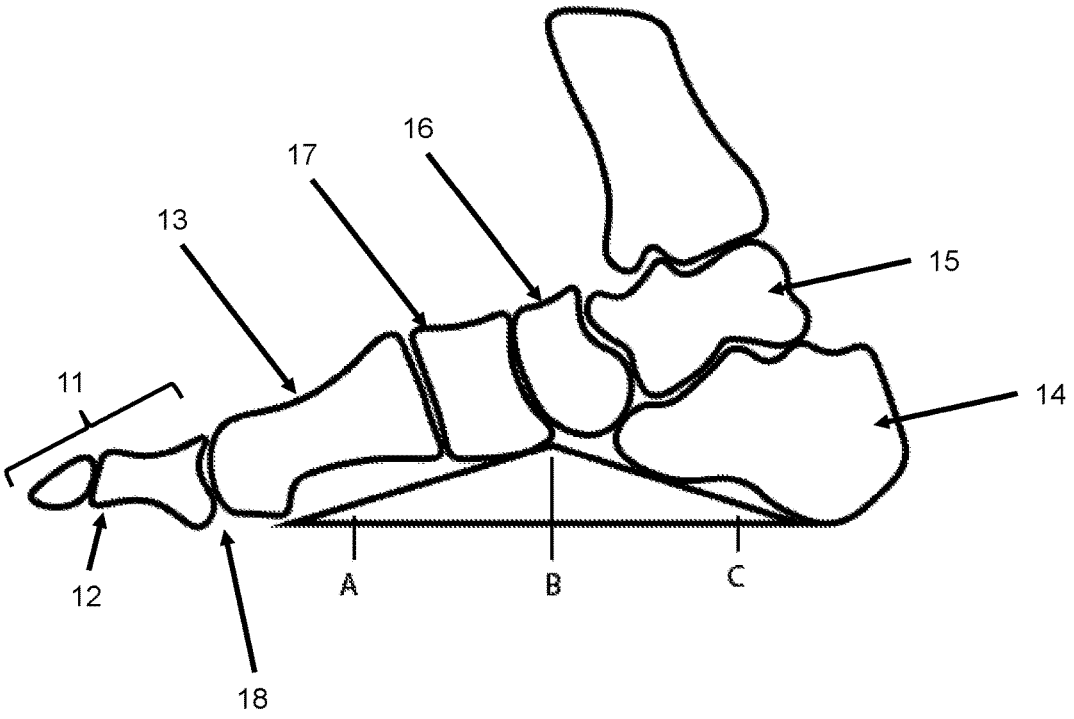
FIG. 4 illustrates a medial side view of a normal bone structure of a right foot with the first metatarsophalangeal joint, the medial arch, and the foot in general in a neutral position.
Figure 5:
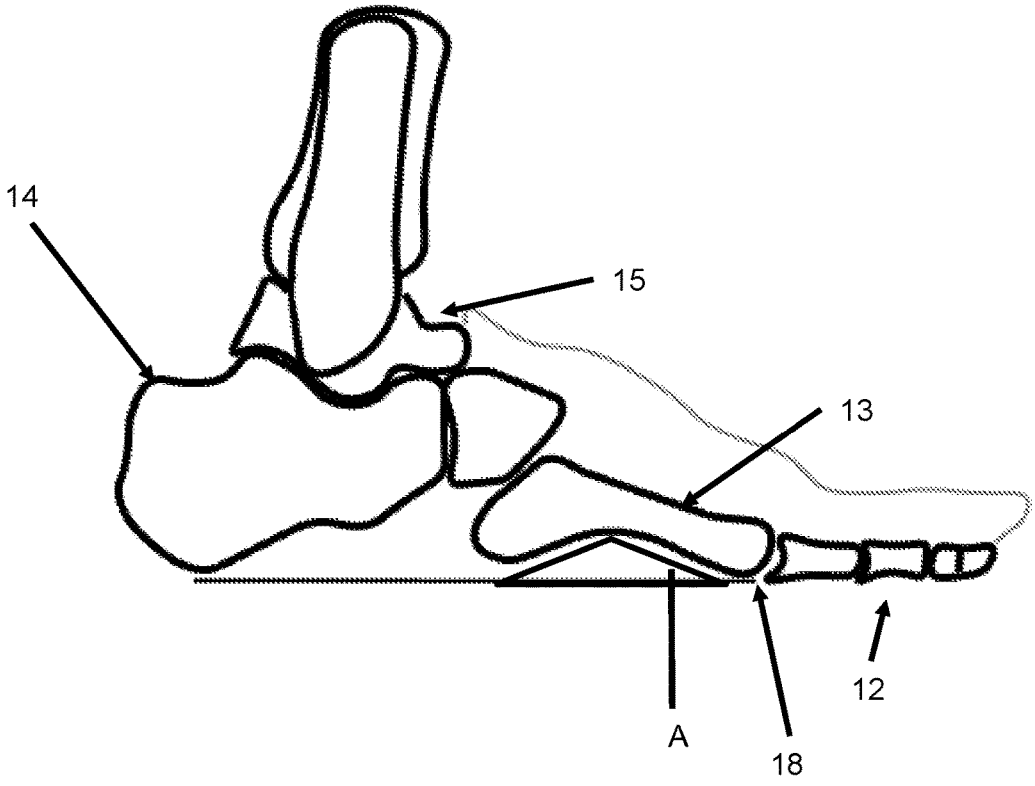
FIG. 5 illustrates a lateral side view of a normal bone structure of a right foot with the fifth metatarsophalangeal joint, the lateral arch, and the foot in general in a neutral position.
Figure 6:
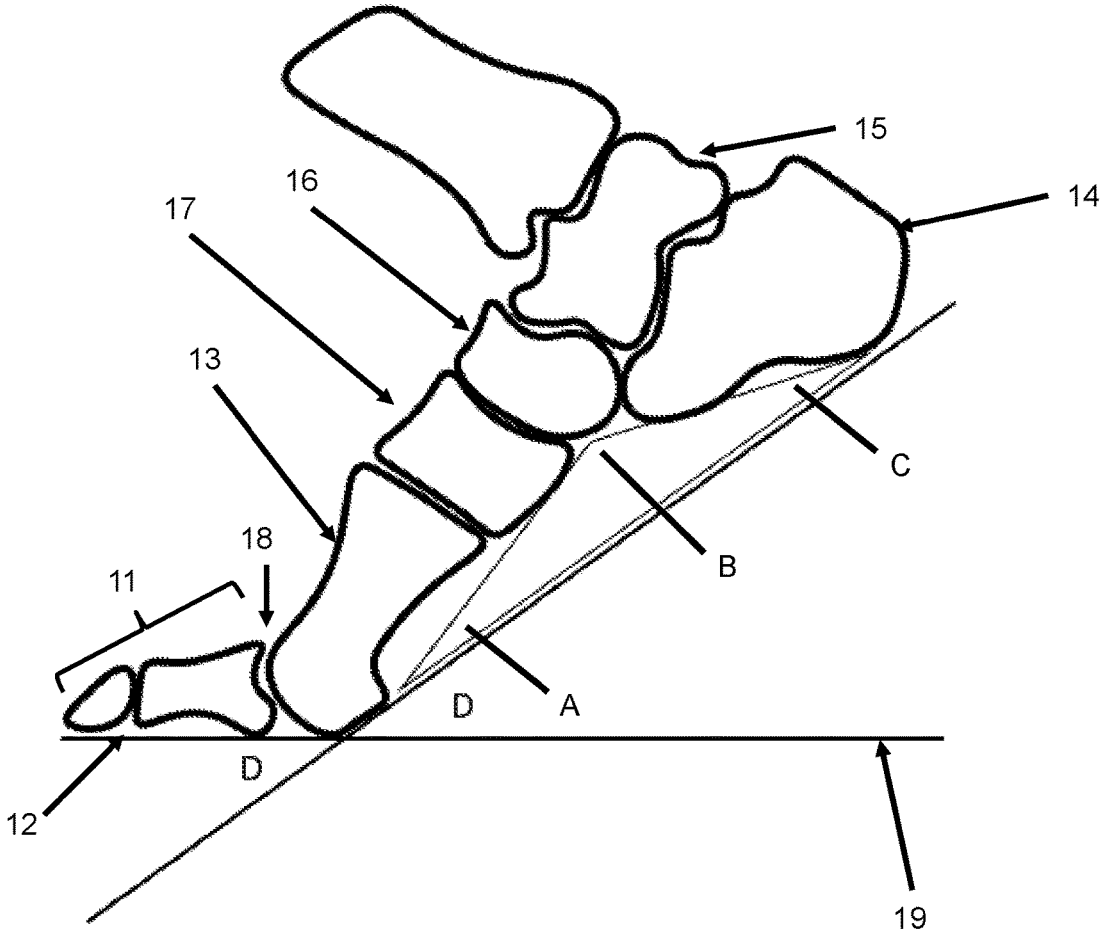
FIG. 6 illustrates a medial side view of a normal bone structure of a right foot with the foot in extension and the forefoot pushing off against the ground.
Figure 7:
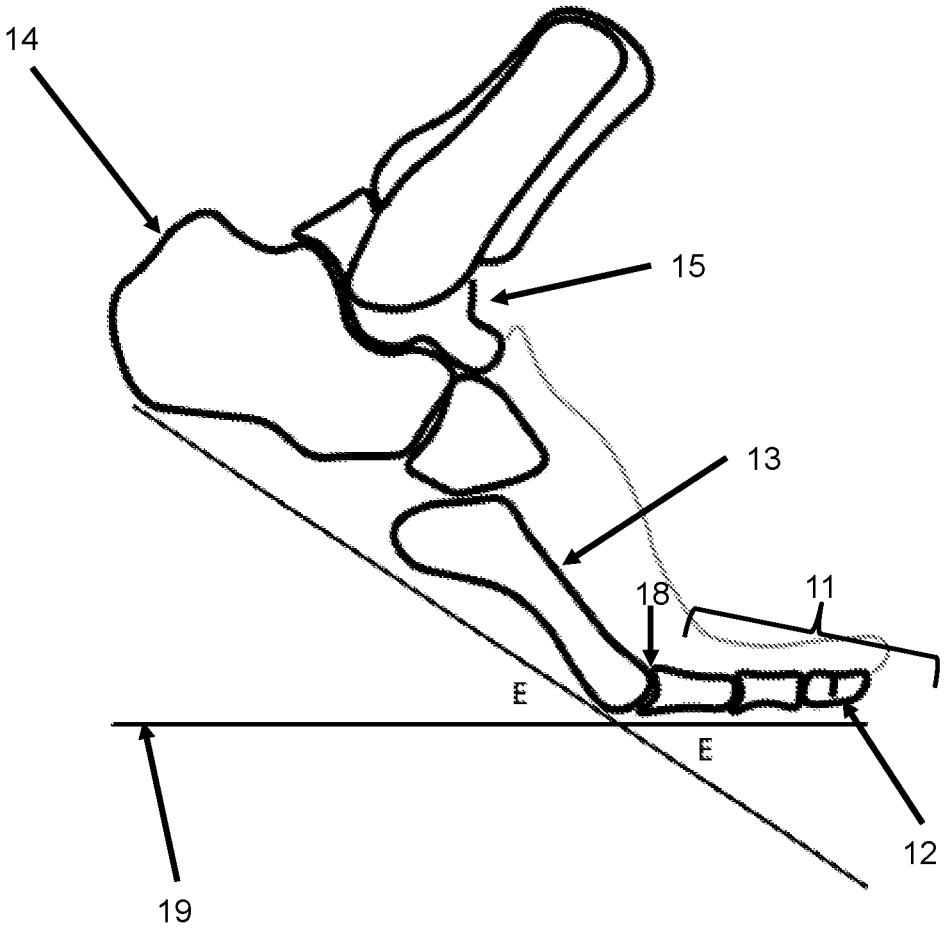
FIG. 7 illustrates a lateral side view of a normal bone structure of the right foot with the foot in extension and the forefoot pushing off against the ground.
Figure 8:
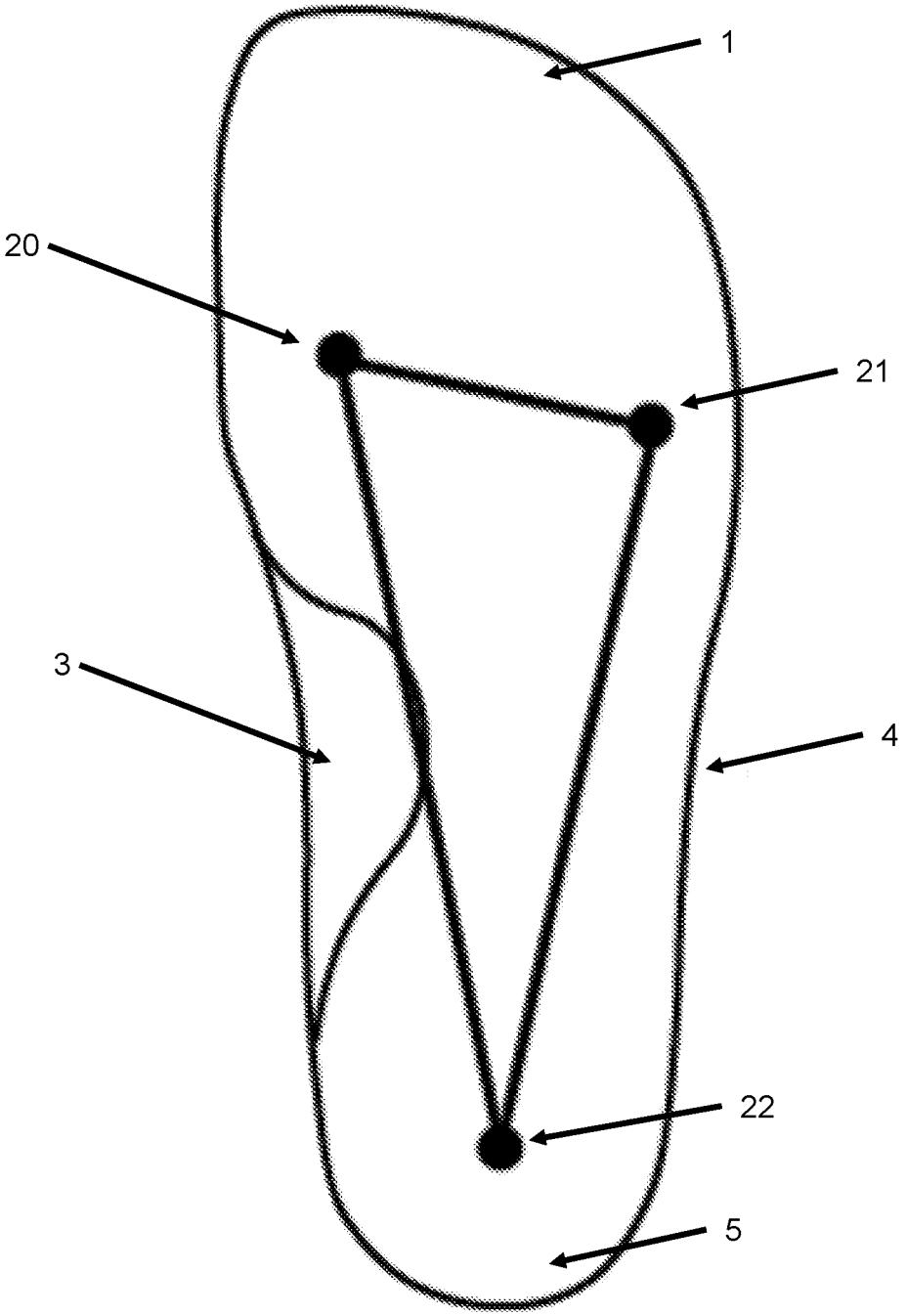
FIG. 8 illustrates the three points of ground contact for a normal right foot.
Figure 9:
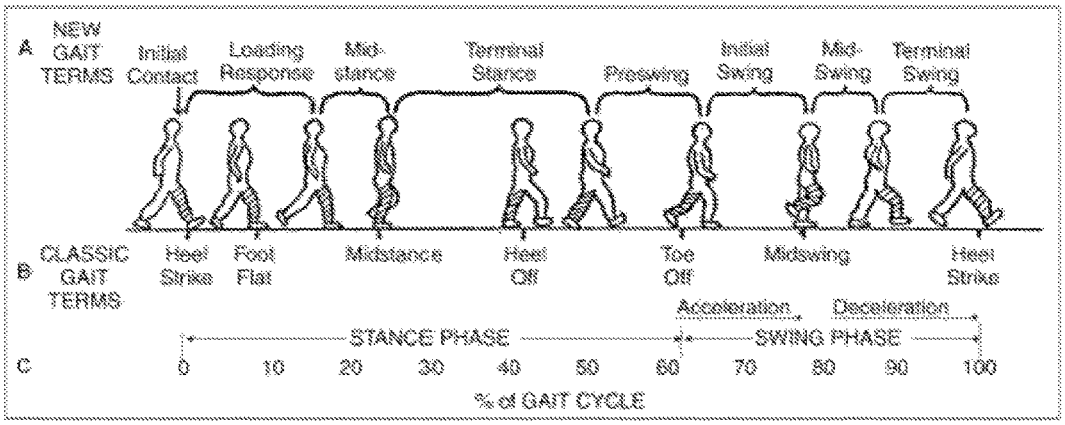
FIG. 9 illustrates the normal gait cycle terminology.
Figure 10:
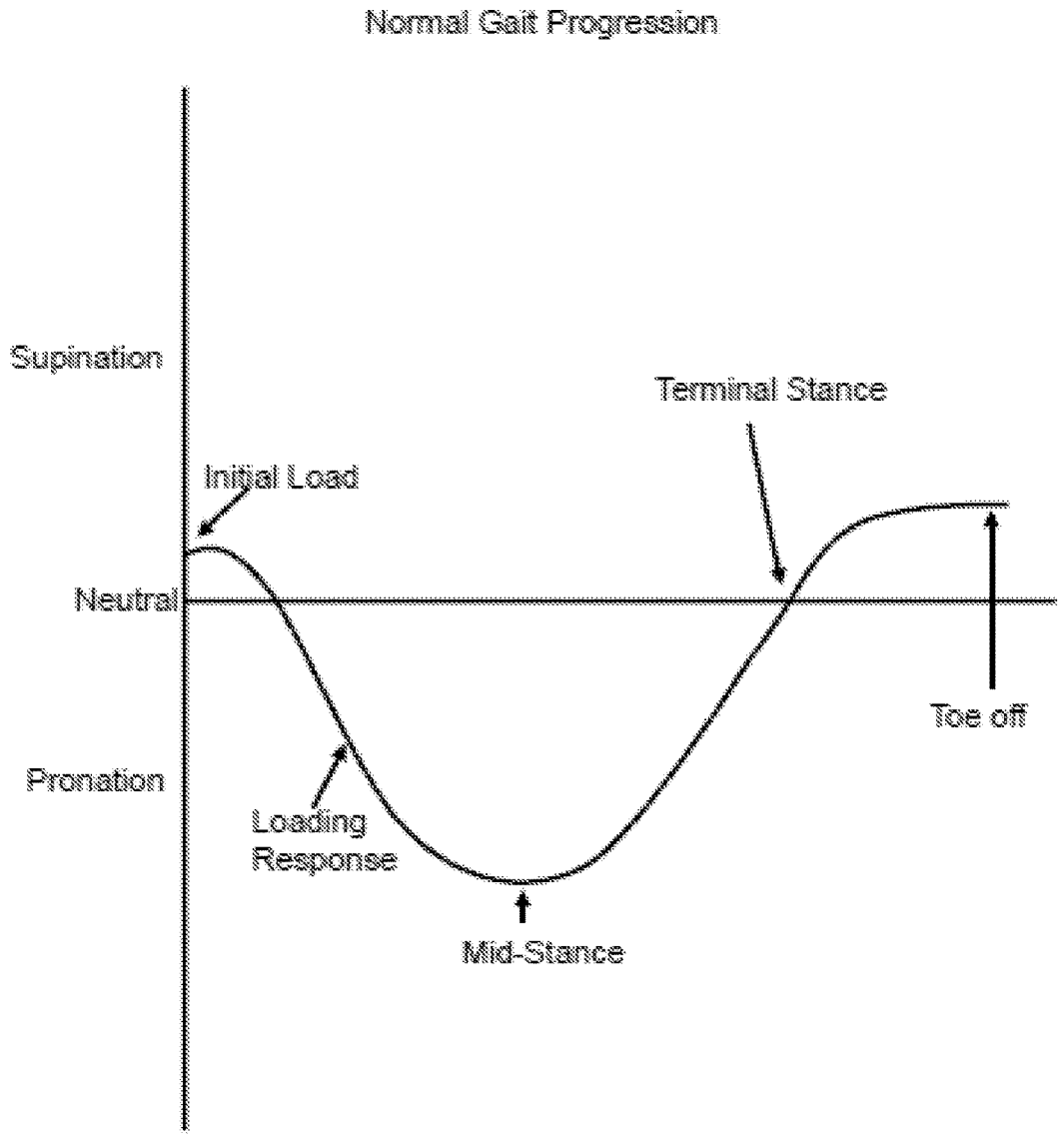
FIG. 10 illustrates the normal single gait progression of a foot from pronation to supination from the initial contact to the toe off foot push off.
Figure 11:
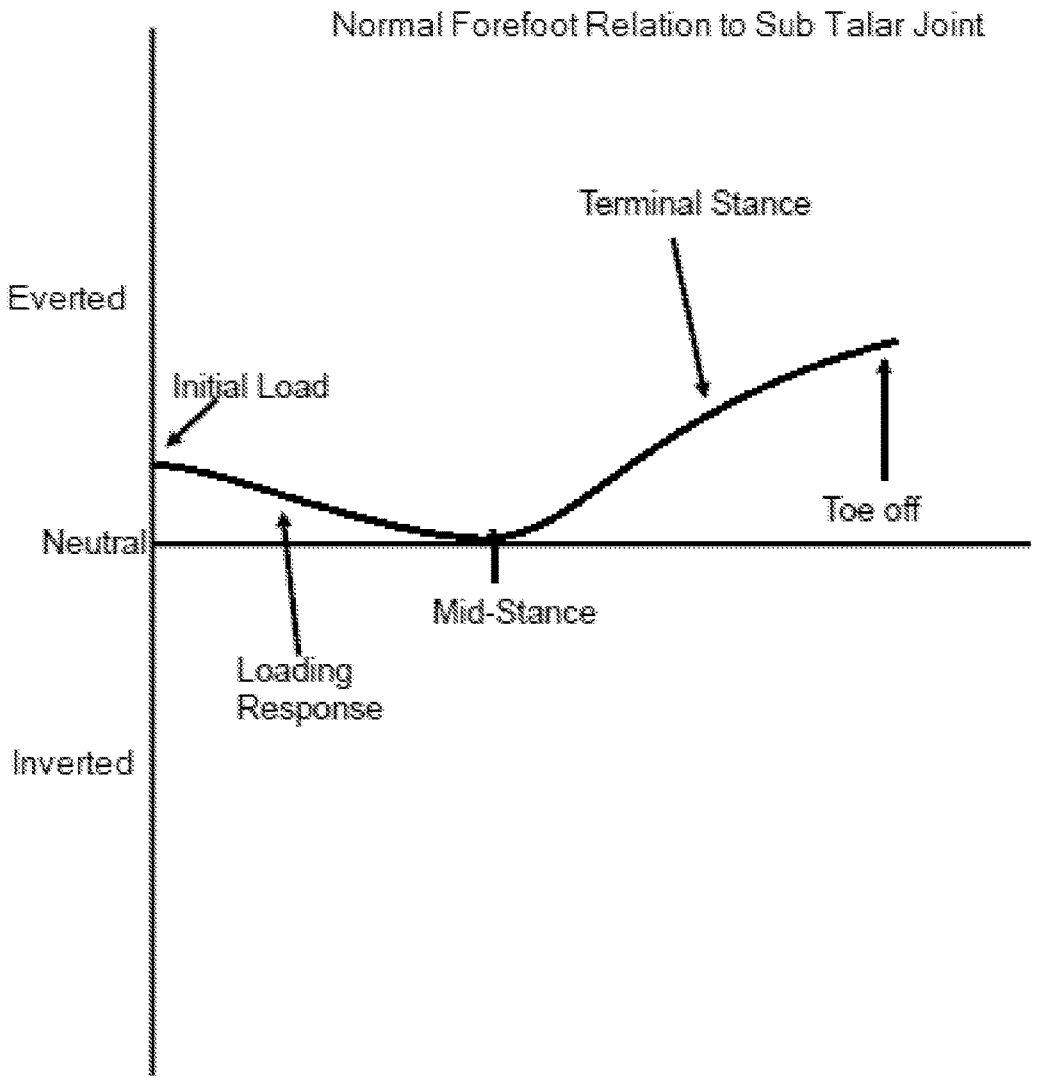
FIG. 11 illustrates the position of everted and inverted of the forefoot plane in relation to the sub talar joint and heel from the initial contact to the toe off foot push off in a proper gait pattern.
Figure 12:
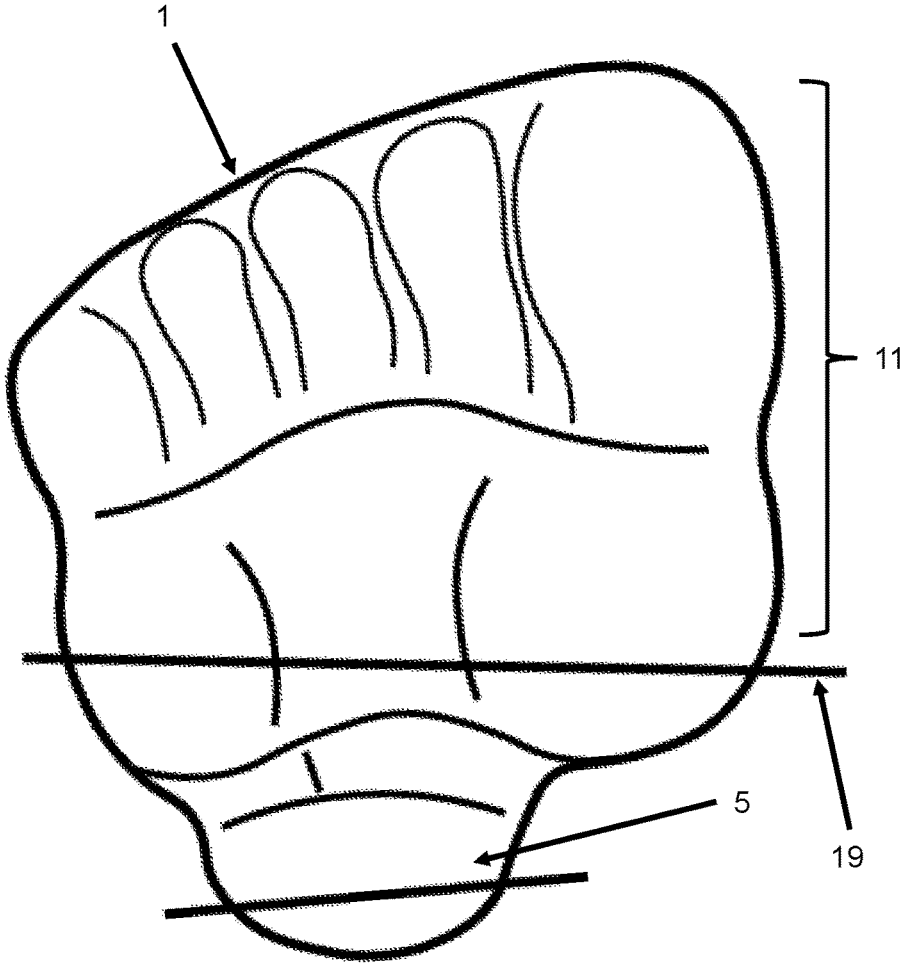
FIG. 12 illustrates a front view and planar relationship of the right foot in extension, with the forefoot everted in relation to the sub talar joint and heel, prior to initial ground contact for a normal healthy foot gait.
Figure 13:
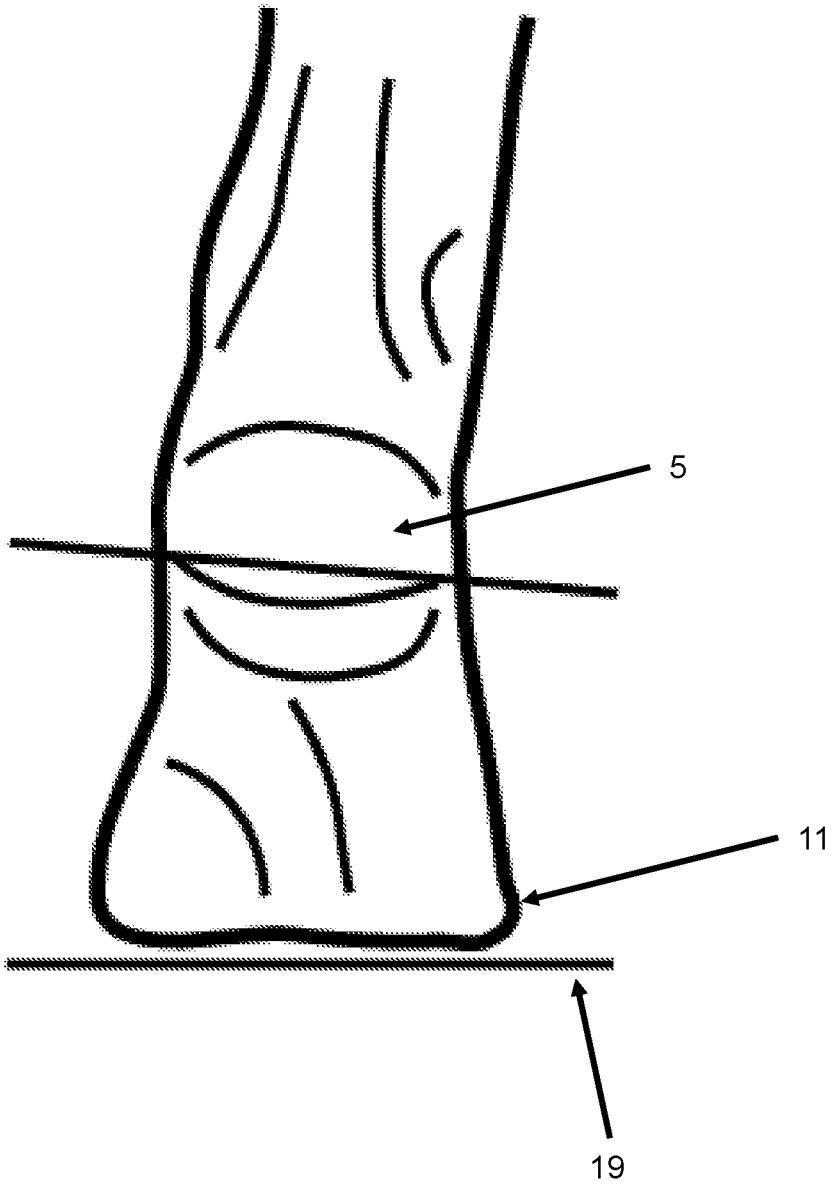
FIG. 13 illustrates a rear view and planar relationship of the right foot in extension, with the forefoot everted in relation to the sub talar joint and heel, during forefoot ground contact push off for a normal healthy foot gait.
Figure 14:
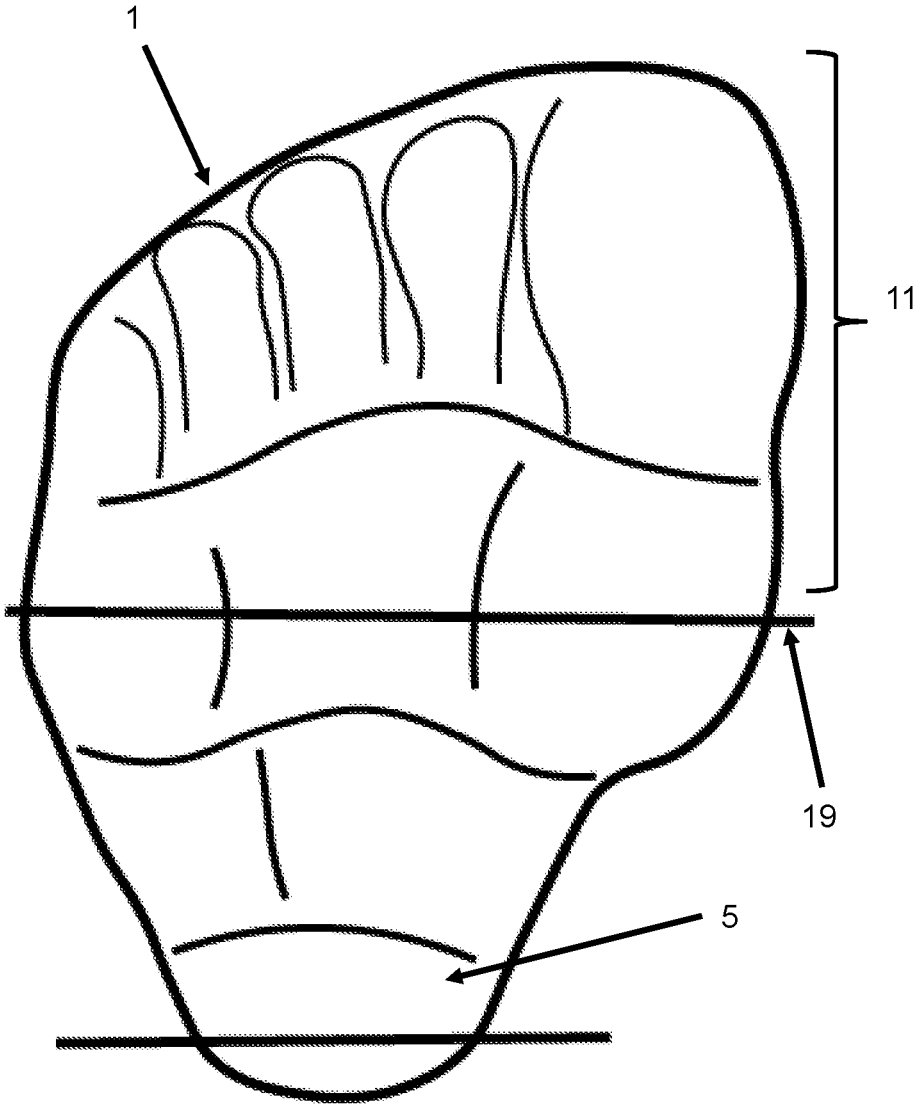
FIG. 14 illustrates a front view of the right foot in a neutral position, with the forefoot in a neutral relationship to the heel and sub talar joint.
Figure 15:
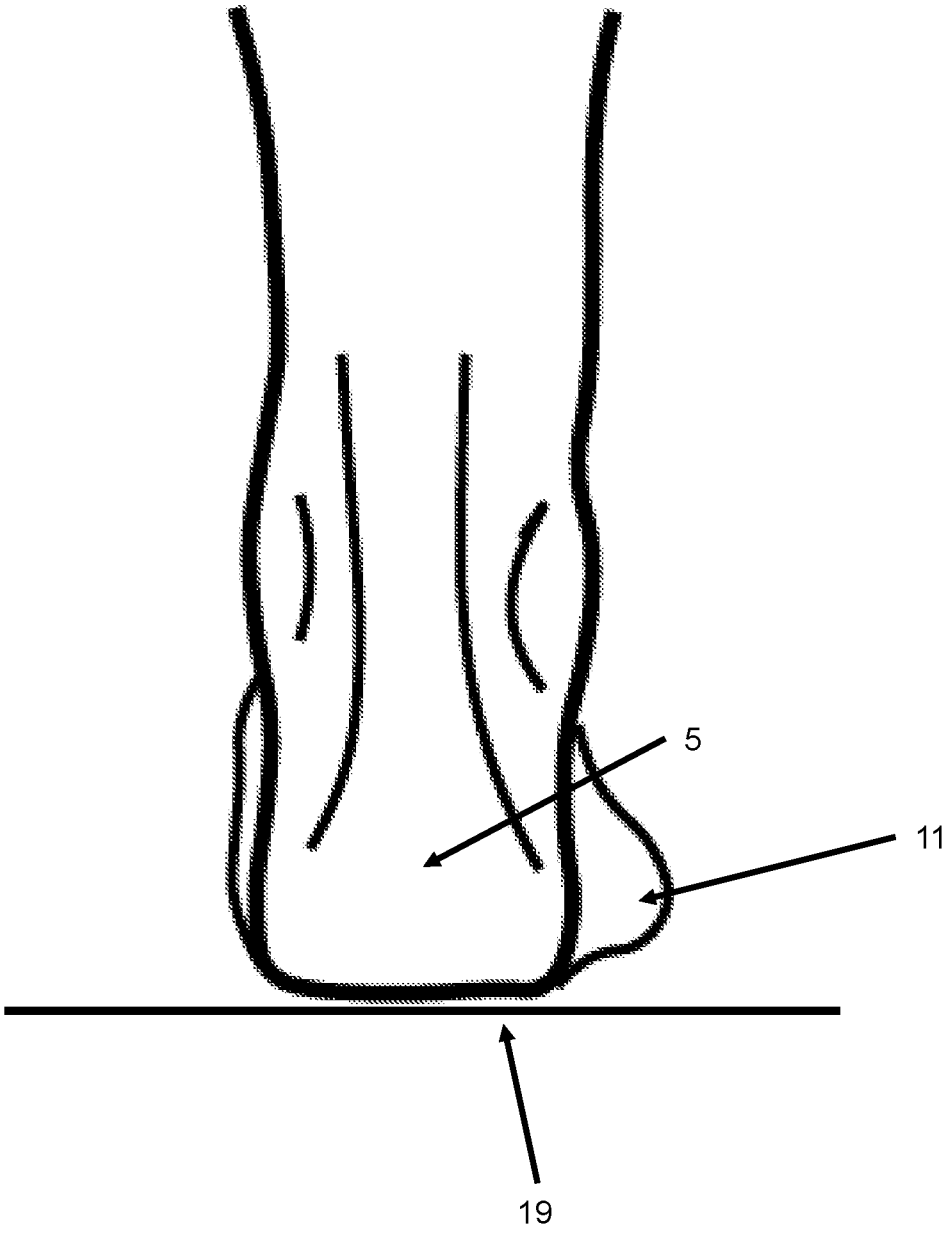
FIG. 15 illustrates a rear view of the right foot in a neutral position in static standing position.
Figure 16:
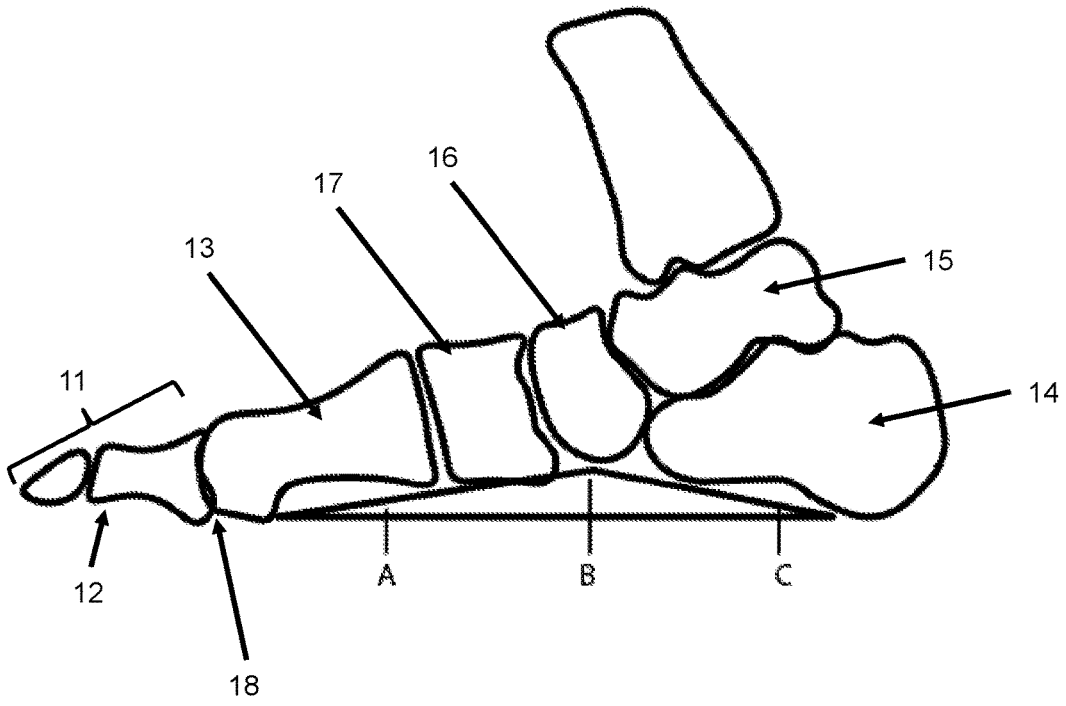
FIG. 16 illustrates a medial side view of a right foot bone structure with an inverted forefoot and lengthened lower medial arch, as occurs during "over pronation" gait pattern and people with forefoot varus.
Figure 17:
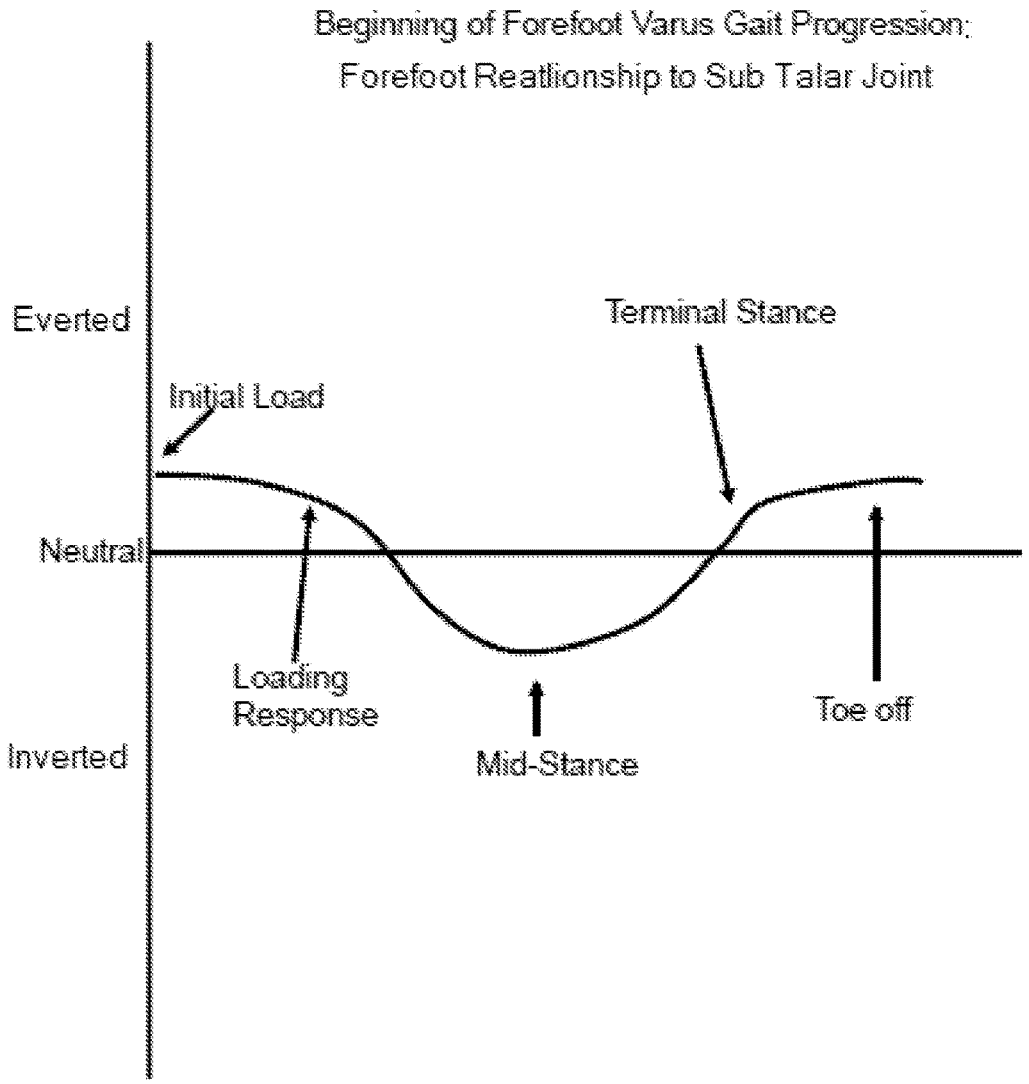
FIG. 17 illustrates the position of everted (valgus) and inverted (varus) of the forefoot plane in relation to the heel from the initial contact to the toe off foot push off in an over pronation gait pattern, caused by restrictive footwear.
Figure 18:
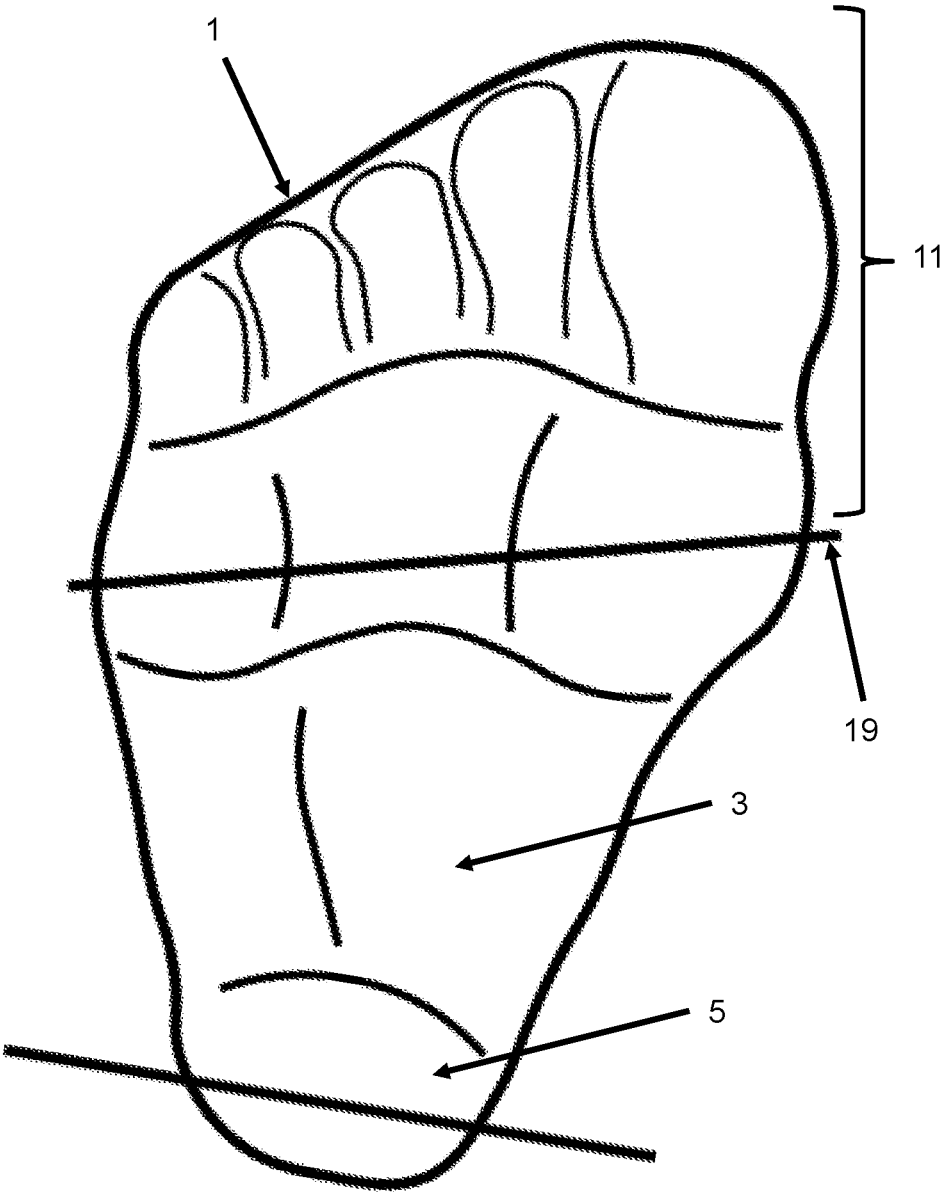
FIG. 18 illustrates a front view of the right foot prior to initial ground contact during a forefoot varus gait pattern, and shows the inverted forefoot relationship to the everted heel.
Figure 19:
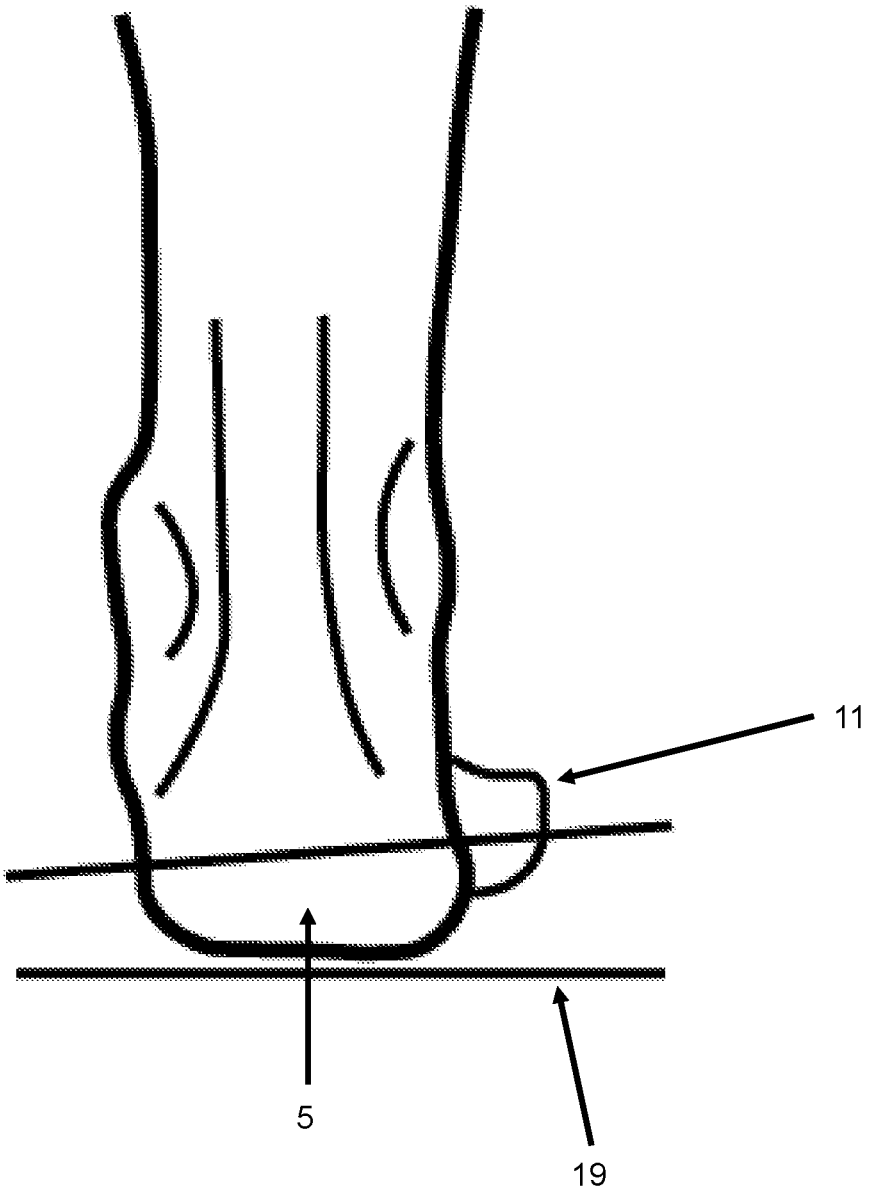
FIG. 19 illustrates a rear view of the right foot in an over pronation or forefoot varus gait pattern.
Figure 20:
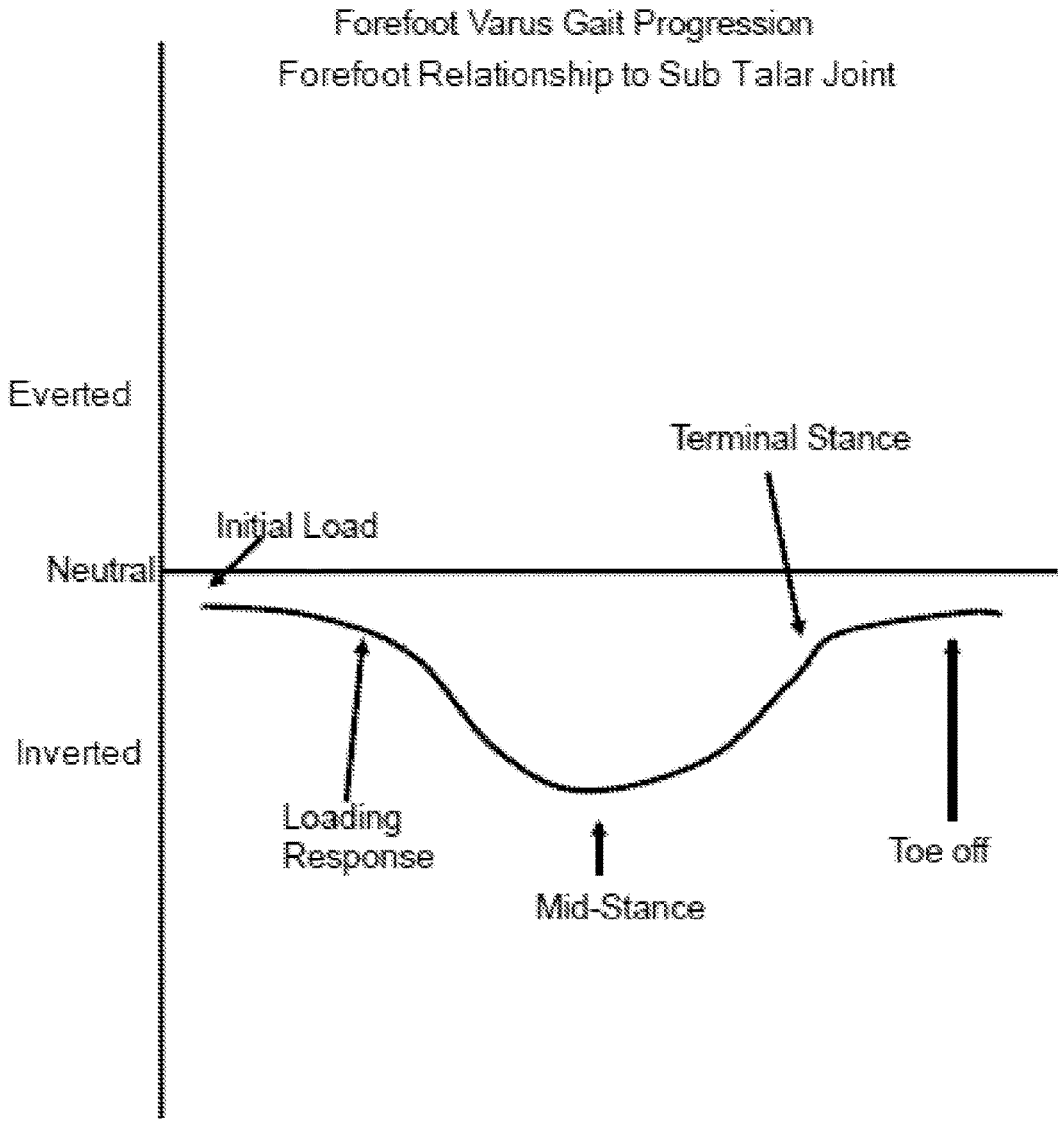
FIG. 20 illustrates the planar relationship between the forefoot, the toes, and the heel of the right foot during heel ground contact during a forefoot varus gait pattern.
Figure 21:
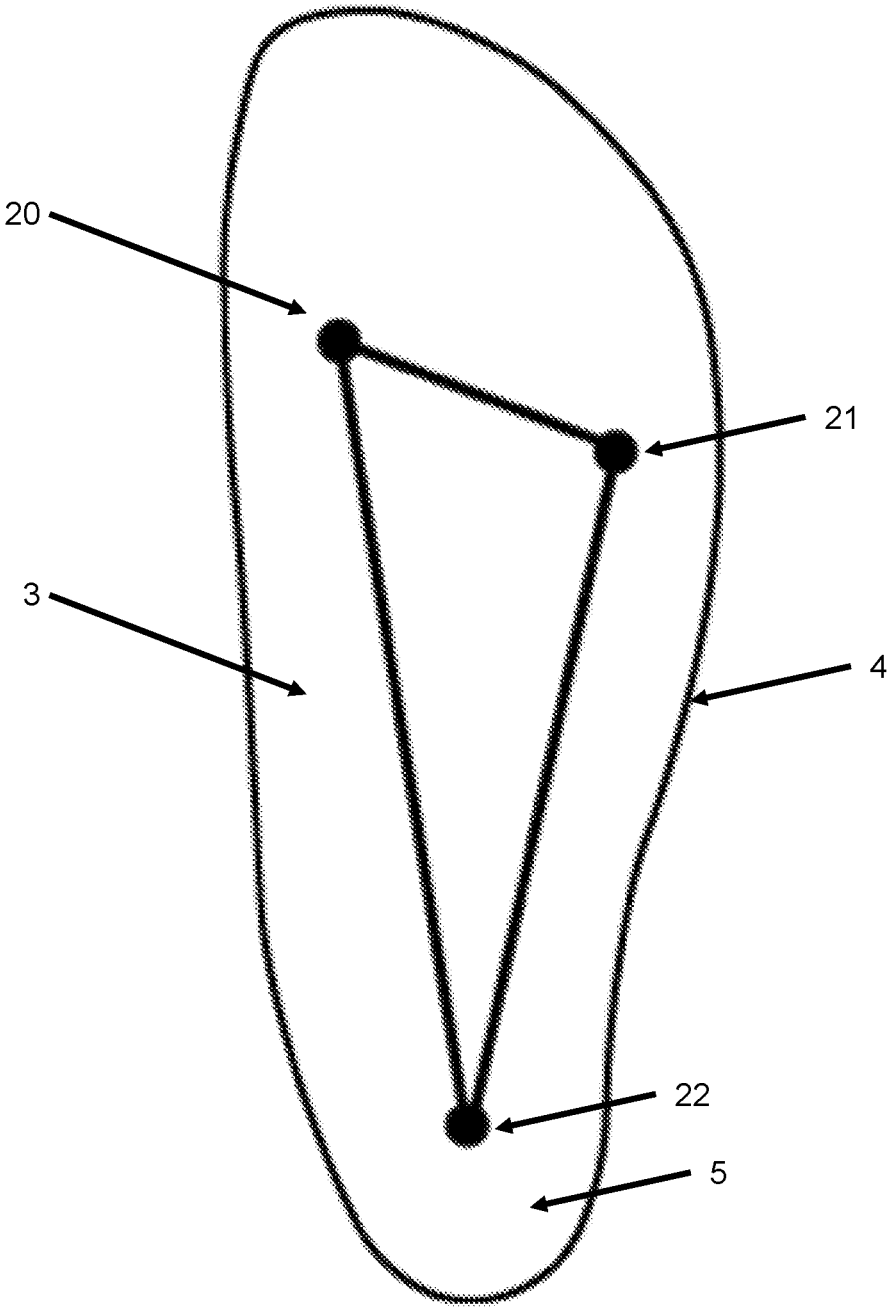
FIG. 21 illustrates the three points of ground contact for a foot suffering from forefoot varus.
Figure 22:
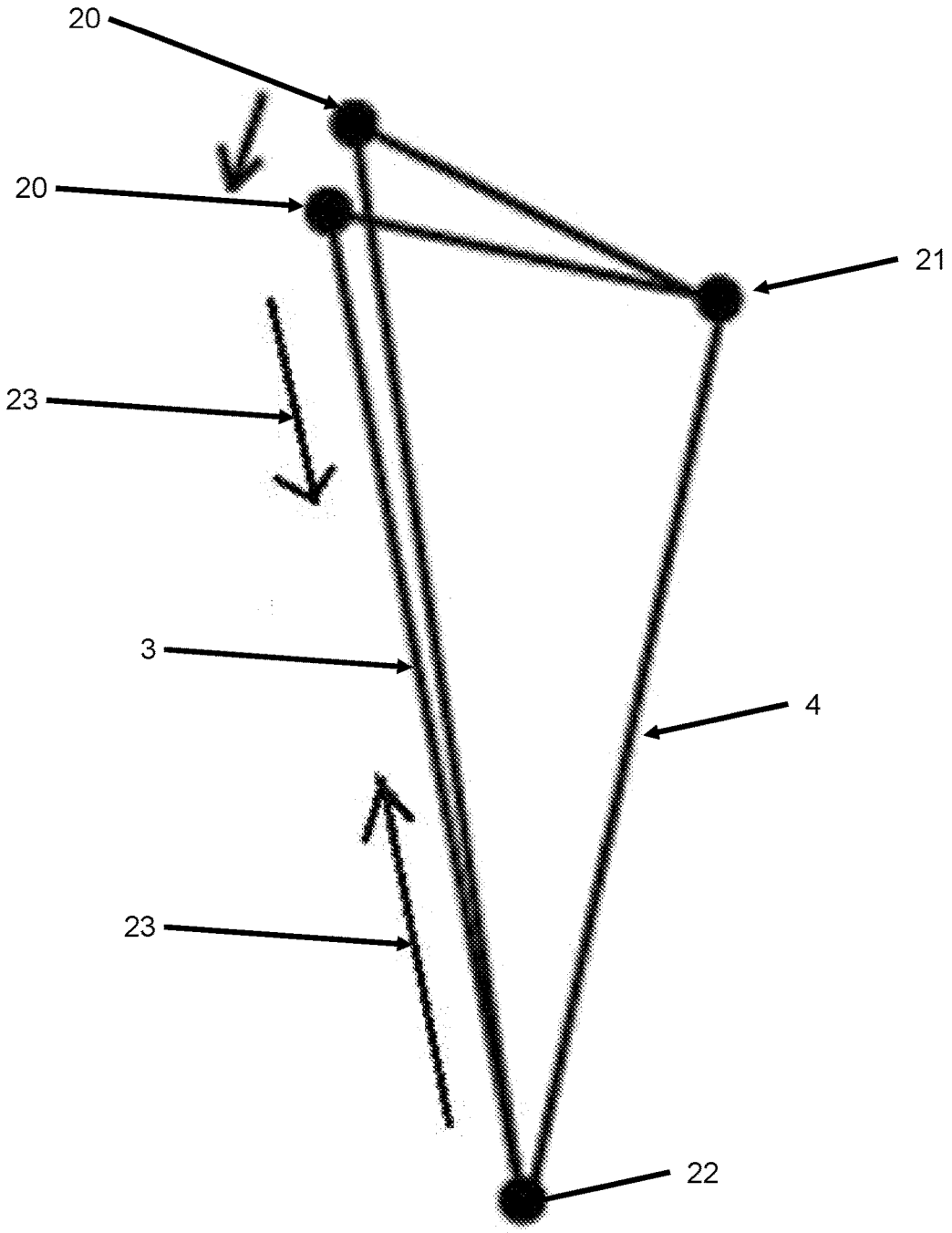
FIG. 22 illustrates the three points of contact on the ground for a foot that has undergone short foot exercises to correct forefoot varus.
Figure 23:
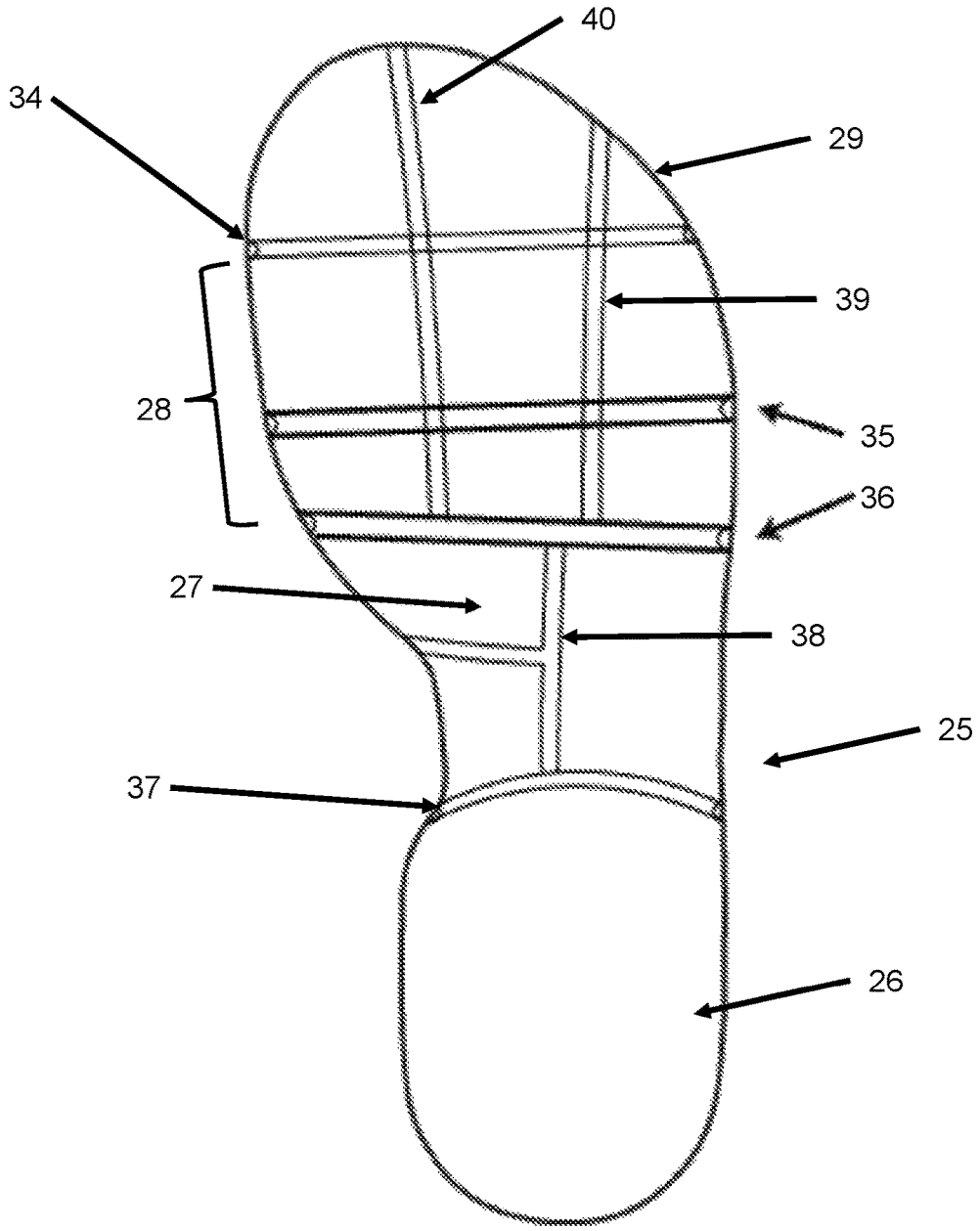
FIG. 23 illustrates a top view of one embodiment of the right sole outsole.
Figure 24:
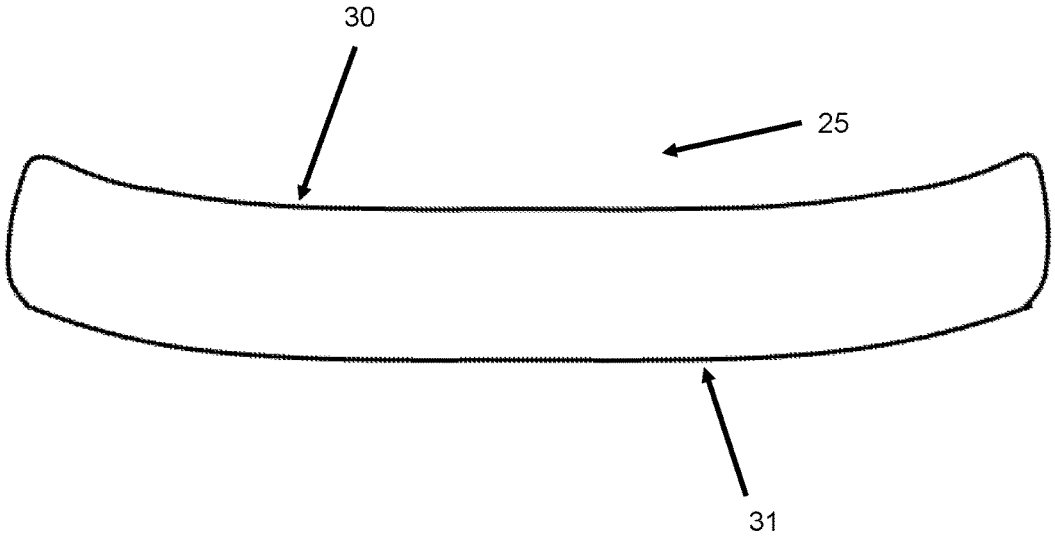
FIG. 24 illustrates a rear cross sectional view of the right sole heel.
Figure 25:
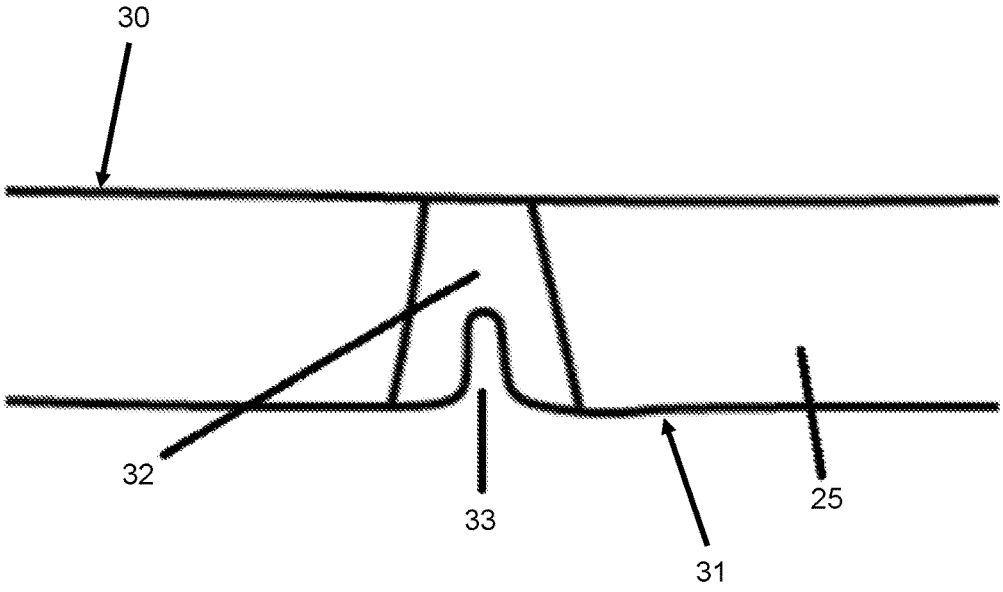
FIG. 25 illustrates a side cross-sectional view of a "closed" flex groove in the forefoot outsole, and illustrates the section that is pre-stretched in a compressed state.
Figure 26:
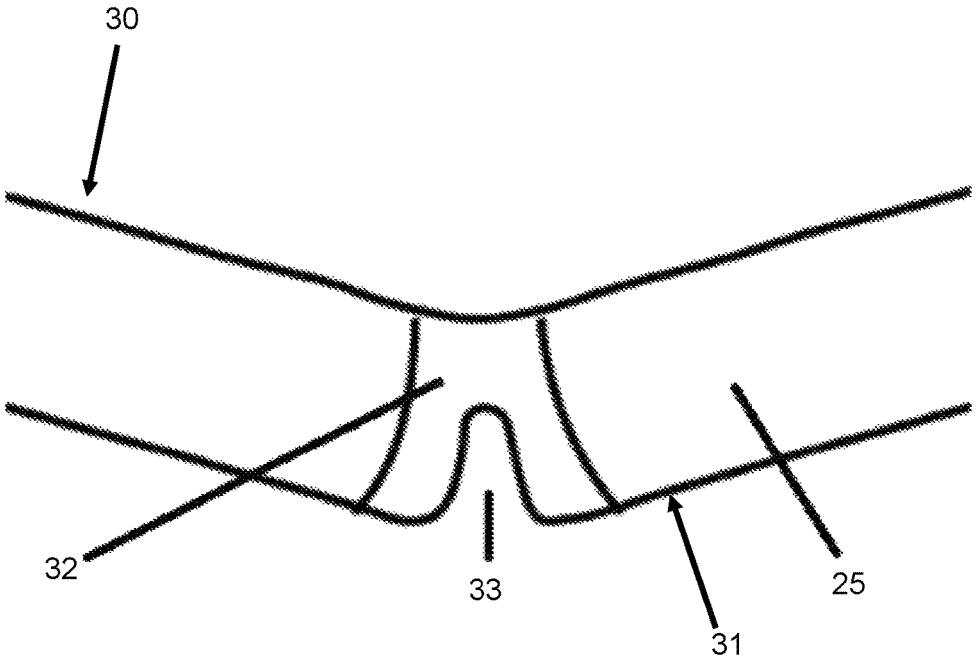
FIG. 26 illustrates a side cross-sectional view of an "open" flex groove in the forefoot sole, and illustrates the section that is pre-stretched.

While several variations of the present invention have been illustrated by way of example in particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

The subject invention discloses modified shoe 24 that comprises a modified sole 25. In embodiments of the subject invention, the shoe 24 includes unmodified components known to those skilled in the art, such as, but not limited to a tongue, a collar, a foot opening, internal surface lining, internal padding, an Achilles tendon pad, a heel counter, eyelets and shoestring, or Velcro® attachments.

In embodiments of the subject invention, the modified sole 25 of the shoe comprises a substantially flat piece composed of firm rubber or plastic material with a heel section 26, a midfoot section 27, a forefoot section 28, a toe box section 29, an inner surface 30, and an outer surface 31. The sole 25 may be have additional internal lining for the shoe 24 on the inner surface 30. The heel 26 and midfoot sections 27 of the shoe 24 will be referred to as the "rearfoot." The toe box 29 is part of the forefoot 28. Therefore, the forefoot 28 and toe box sections 29 will be referred to as the "forefoot."

The modified shoe 24 comprises substantially the same level of cushion in heel section 26, midfoot section 27, forefoot section 28, and the toe box section 29. This cushioning will allow a person to stand in a neutral position, placing more weight in the rear muscles of the legs and in the front muscles of a person's core. This shoe 24 will allow a person's knees and back pressure to be reduced. The extension elements of the shoe will allow a person contract the muscles in the body that are used during extension, and to not overuse the muscles in the body that are used during flexion.

As illustrated in FIGS. 23, 25-46, the modified sole 25 comprises a plurality of vertical connection sections, each composed of elastic material 32 which compresses and stretches, and an open pre-stretched flexible groove 33 on the bottom surface 31. In embodiments of the subject invention, the sole may contain a vertical connection 34 that traverses the sole 25 from the medial side to the lateral side between the toe box section 29 and the forefoot section 28. The sole may contain a vertical connection 35 that traverses the sole 25 from the medial side to the lateral side in the middle of the forefoot section 28. The sole may also contain a vertical connection 36 that traverses the sole 25 from the medial side to the lateral side between the forefoot section 28 and the midfoot section 27. The sole may further contain a vertical connection 37 that traverses the sole 25 from the medial side to the lateral side between the midfoot section 27 and the heel section 26. The sole may further contain a vertical connection 38 that located between vertical connections 36 and 37. The sole may also contain vertical connection 39 and 40 located between vertical connection 34, 35, 36 and the end of the toe box section 29.

The plurality of vertical connection sections 34-37, permit the heel section 26, midfoot section 27, forefoot section 28, and the toe box section 29 to operate, move, and flex relatively independent of each other allowing the sole 25, the shoe 24, and a foot contained within to conform to multiple planes, as opposed to one single plane.

The modified heel section 26 of the sole 25 comprises a substantially rounded bottom. This modified heel 26 has a uniform thickness in the center, medial side, and lateral side. The medial and lateral sides raise up gradually to contour a person's heel. The medial and lateral side each raise up to a maximum of 10 degree difference from the center. This allows a person to land on both the central portion and the lateral portion of the heel at a variety of angles with the ground surface, ranging from 0 to 10 degrees. The angle at which a person naturally should strike his or her heel against the ground surface varies from person to person. In embodiments of the subject invention, the angle of heel contact with the ground surface may vary in a person in their left foot and right foot.

The modified midfoot section 27 of the sole 25 comprises a substantially rounded bottom surface with a central portion, a higher medial arch portion, and a lower lateral arch portion. This is designed to naturally contour the bottom of the midfoot. This modified midfoot allows a person to land on the lateral arch portion of the midfoot at a variety of angles with the ground surface. The angle at which a person naturally should strike his or her midfoot lateral arch against the ground surface varies from person to person. In embodiments of the subject invention, the angle of lateral arch contact with the ground surface may vary in a person in their left foot and right foot. In embodiments of the subject invention, the lateral arch portion of the midfoot may comprise angles ranging from 0 to 10 degrees to allow for lateral arch contact with the ground surface at angles ranging from 0 to 10 degrees.

The shape of the midfoot section 27 comprises a substantially straight line from the outside of the heel section 26 to the outside of the forefoot section 28. The sole 25 of the shoe 24 substantially runs along the lateral arch 4 of the midfoot. The shape of the midfoot substantially aligns with the generally straight line of a person's foot along the lateral arch 4. The medial arch 3 will not comprise padding underneath. The lack of sole material underneath the medial arch 3 allows the medial forefoot section 28 of the sole 25 to have more flexibility, and to operate more independently from the rearfoot.

The modified midfoot section 27 of the shoe 24 comprises more lateral room than traditional athletic shoes. The midfoot section 27 allows the base of the fifth metatarsal bone to land naturally on the ground without being forced medially, or towards the middle of the foot. The shoe 24 of the subject invention avoids the narrower midfoot portion disclosed by prior art shoes. The shoe does not squeeze the outside of the midfoot.

The shoe of the subject invention permits each foot to begin with the forefoot section 27 everted in relation to the heel 26 and midfoot sections 27. The shoe 24 permits each foot to land in the middle to lateral side of the heel 5 in an inverted heel position. The extended, hinged, and everted forefoot section then makes contact with the ground. The forefoot section 28 flexes along vertical connections 34, 35, and 36 by un-hinging and inverting to a neutral relation with the heel section 37, with the help of the toe box section 29 coming in contact with the ground. The forefoot section 28 of the shoe is then allowed to re-extend along vertical connections 34, 35, and 36 by hinging and everting again while maintaining ground contact as the heel section 26 lifts off the ground and inverts along vertical connection 37.

In embodiments of the subject invention, the lateral arch portion of the sole 25 will be raised 1 to 2 mm from the heel section 26. The lateral arch portion of the sole 25 will touch down to the ground as the material in the heel section 26 is compressed by a person's weight. This will allow the lateral midfoot to take on pressure while in a standing position. The lateral midfoot will only be weight bearing if both the heel and forefoot are also weight bearing. In non-weight bearing, the forefoot will be angled up 15 degrees from the lateral arch. In weight bearing, the forefoot flexes by un-hinging to the same plane as the heel.

The modified forefoot section 28 of the shoe 24 comprises a substantially flat bottom. This forefoot section 28 has a uniform thickness in the center, medial side, and lateral side, and in the toe box section 29. The forefoot section 28 of the shoe comprises a substantially flexible section. The shape of the forefoot differs from the majority of prior art. The shape of the forefoot is modeled after the foot's natural shape when in "short foot" exercise. The toes are spread out, as opposed to squeezed towards the center. Thus, the side of the forefoot comprises a substantially straight line from the outside of the metatarsophalangeal joints to the toe box. The forefoot section 28 of the shoe 24 is slightly wider than in prior art.

The forefoot section 28 of the 24 shoe operates independently from the rearfoot through vertical connections 34, 35, and 36. The flexibility between the forefoot and rearfoot occurs underneath the metatarsophalangeal joints. This flexibility may be executed in multiple ways. Two flexible vertical connections 34 and 35 with deep grooves run horizontally on the forefoot section 28 under the metatarsophalangeal joints 18. The first vertical connection 34 begins from under the center of the first MTP joint 18, and contours slightly towards the front side of the fifth MTP joint 18. The second vertical connection 35 is located from under the rear side of the first MTP joint 18, and contours slightly towards the rear of the shoe to the rear side of the fifth MTP joint 18. Thus, the vertical connections 34 and 35 are closer together on the medial side of the shoe 24 than on the lateral side of the shoe 24. This helps the forefoot evert from the rearfoot when the vertical connections 34 and 35 are "open" or hinged.

The vertical connections 34 and 35 in the forefoot section 28 go through a manufacturing process that allows grooves 33 within each of them to be "open" and allow a moderately hinged and everted forefoot in a non-weight bearing position. The grooves 33 of vertical connections 34 and 35 are then allowed to close, which un-hinges the forefoot to be on the same plane as the rearfoot. The grooves 33 of vertical connections 34 and 35 are also allowed to open further, which hinges the forefoot up to 45 degrees.

Figure 27:
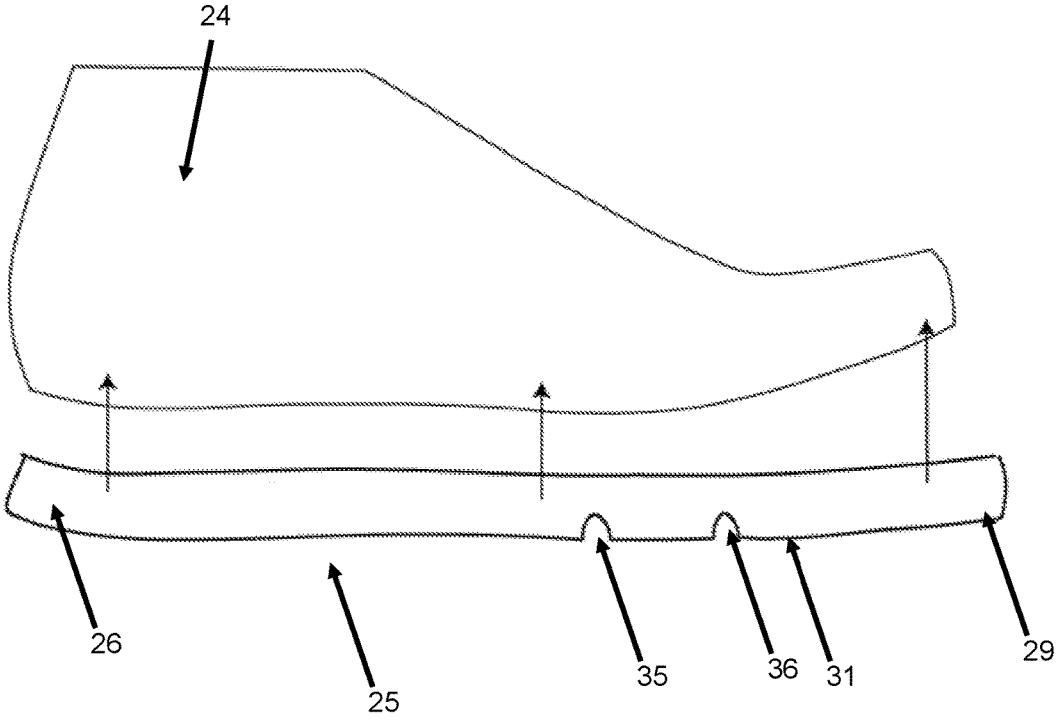
FIG. 27 illustrates a lateral side view of the right outsole (un-hinged, without toe spring) being applied to a last with a 15 degree toe spring.

The process for creating opening flexible grooves 33 that close easily with the internal pressure of the foot is to first create the mold for the sole 25 so that the flexible grooves 33 are closed and the hinge degree at the MTP's 18 is at 0. Second, the flexible grooves 33 and the sole material directly above the flexible grooves 33 must be heated to re-mold the sole 24 to hinge at the MTP's 18 at approximately 15 degrees, creating a moderately open flexible grooves 33. The sole is then applied to a last with a 15 degree toe spring, as illustrated in FIG. 27. In further embodiments of the subject invention, other processes, known to those skilled in the art may be used to create a pre-stretched open flexible grooves 33.

Figure 28:
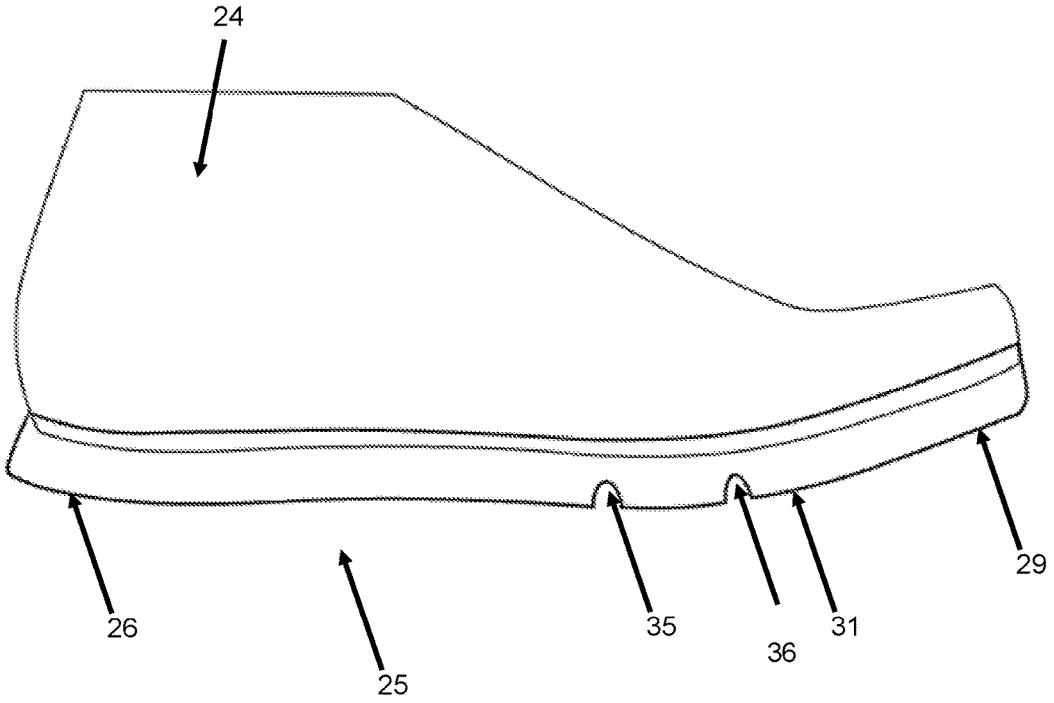
FIG. 28 illustrates a lateral side view of the right shoe after the manufacturing process is finished.
Figure 29:
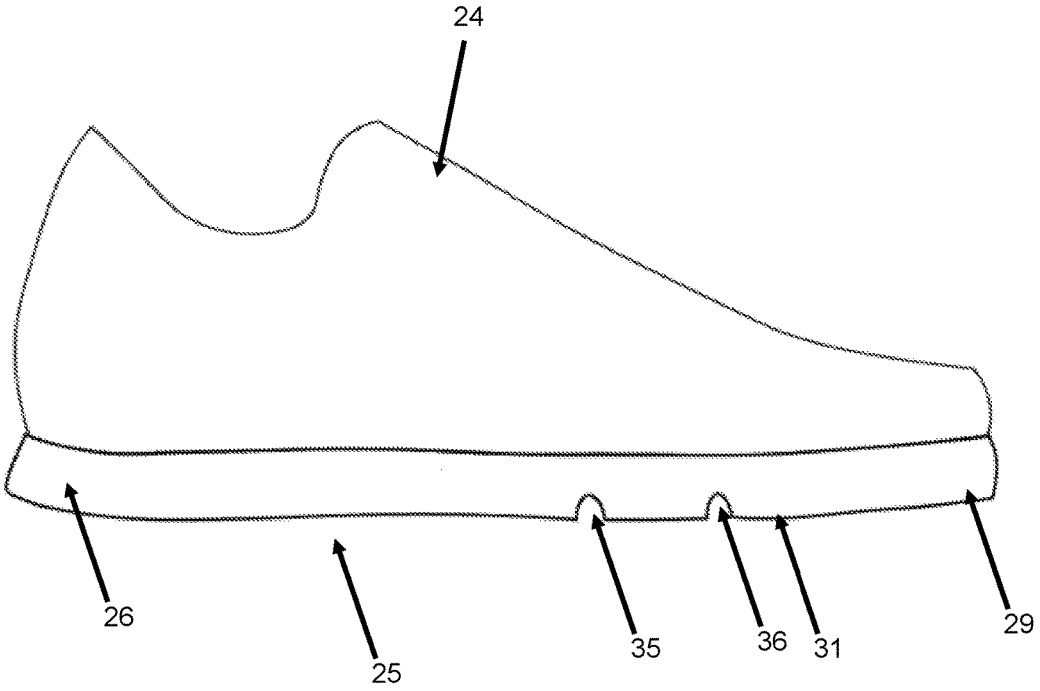
FIG. 29 illustrates a lateral side view of the right shoe in a neutral position, as in mid stance.

This allows the flexible grooves 33 to be open and the shoe to be moderately hinged to 15 degrees in a non-weight bearing position, as illustrated in FIG. 28. It also allows the flexible grooves 33 and the shoe 24 to return to its original molded position of closed flex grooves and un-hinged with the internal pressure of the foot in neutral flexion position, as illustrated in FIG. 29.

As illustrated in FIG. 28, the sole 25 of this shoe 24 remains in this position unless there are forces put onto the shoe by the foot or external forces.

Figure 30:
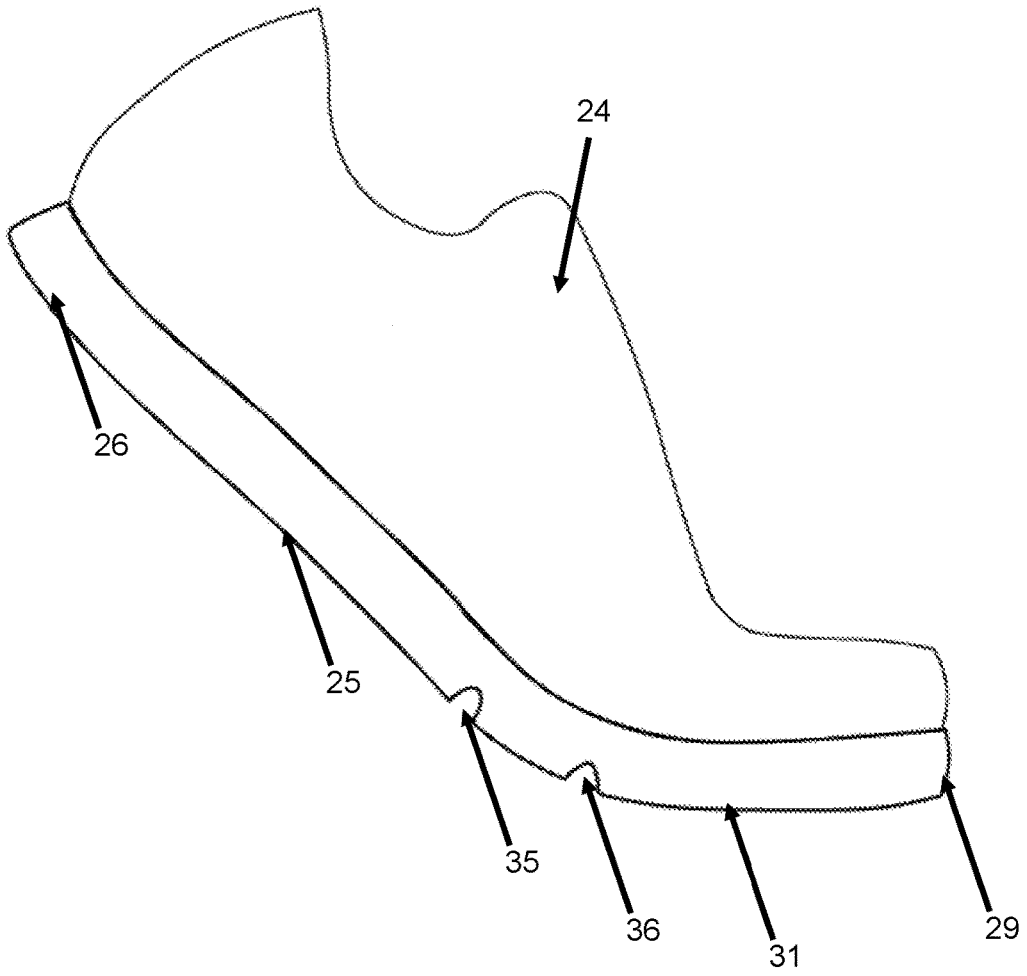
FIG. 30 illustrates a lateral side view of the right shoe in a position of full extension, as in terminal stance.
Figure 31:
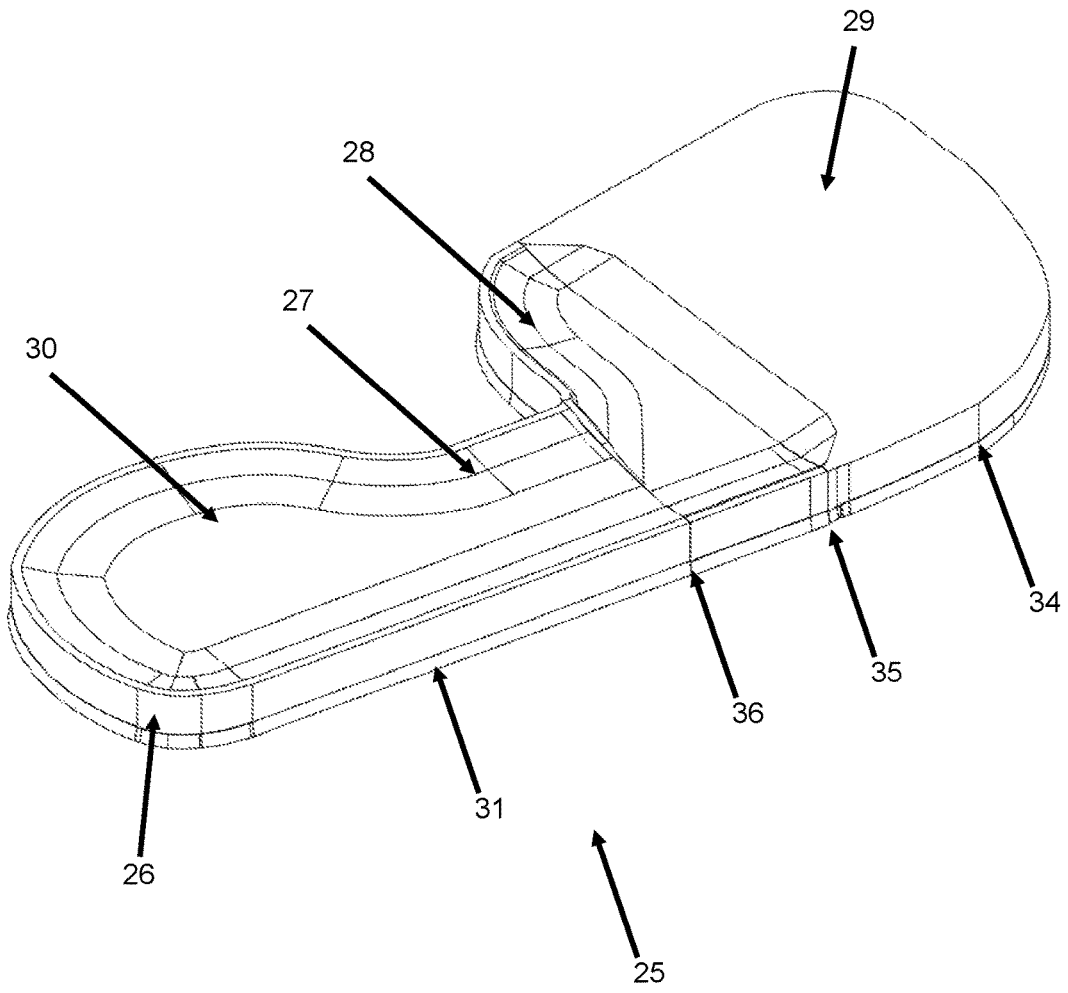
FIG. 31 illustrates of a perspective view of another embodiment of the right sole in neutral position.
Figure 32:
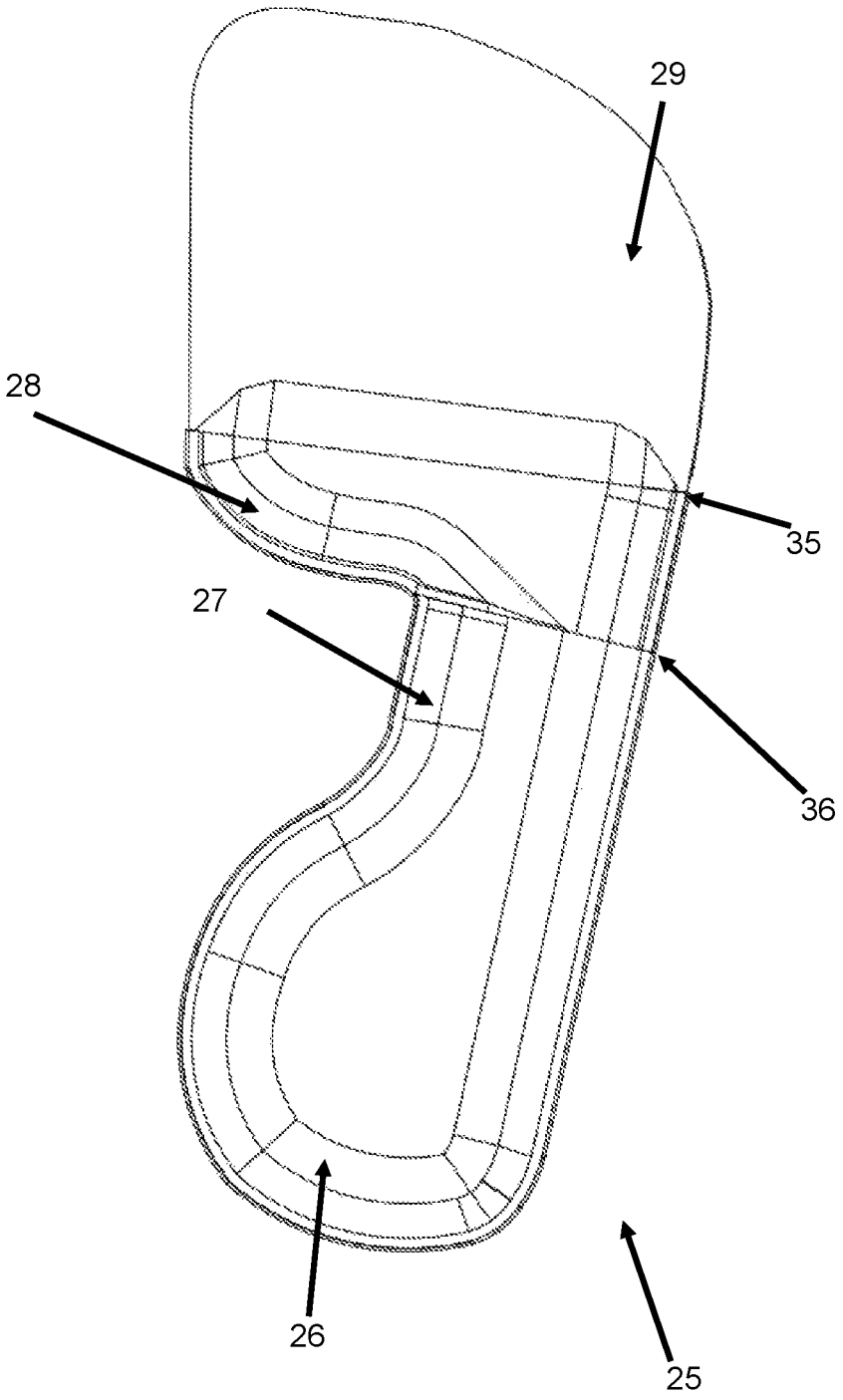
FIG. 32 illustrates of a top view of another embodiment of the right sole in a neutral position.
Figure 33:
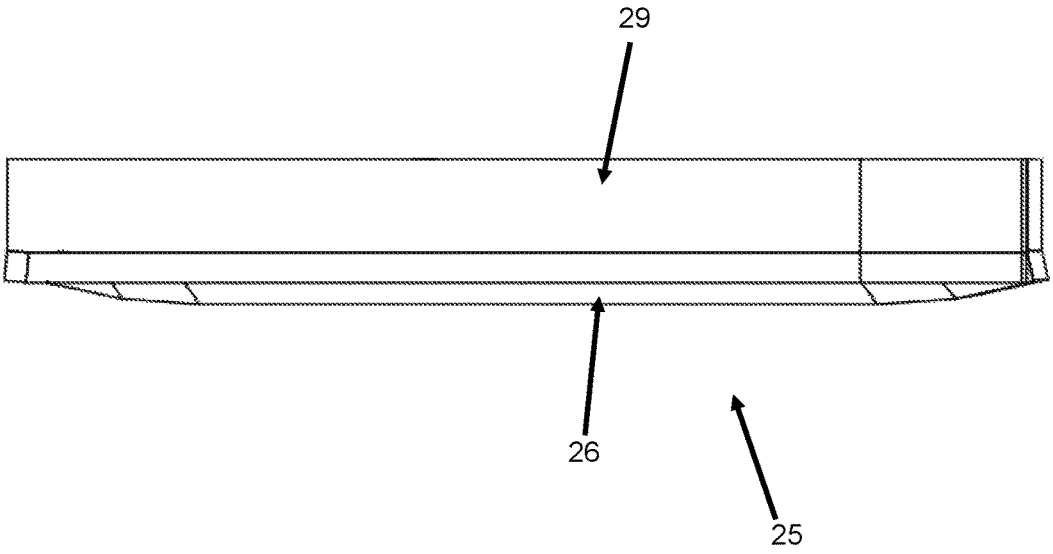
FIG. 33 illustrates of a front view of the right sole in a neutral position.
Figure 34:
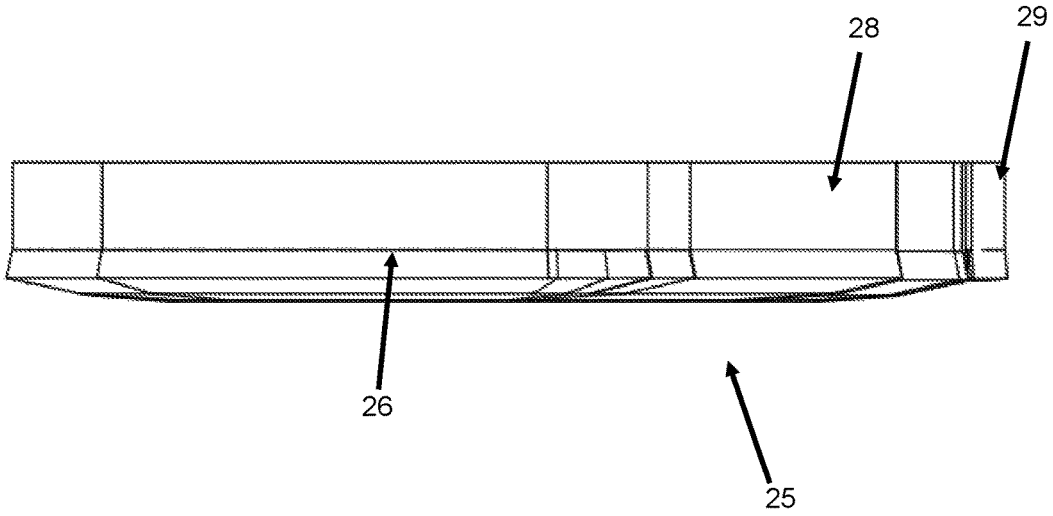
FIG. 34 illustrates of a rear view of the right sole in a neutral position.
Figure 35:
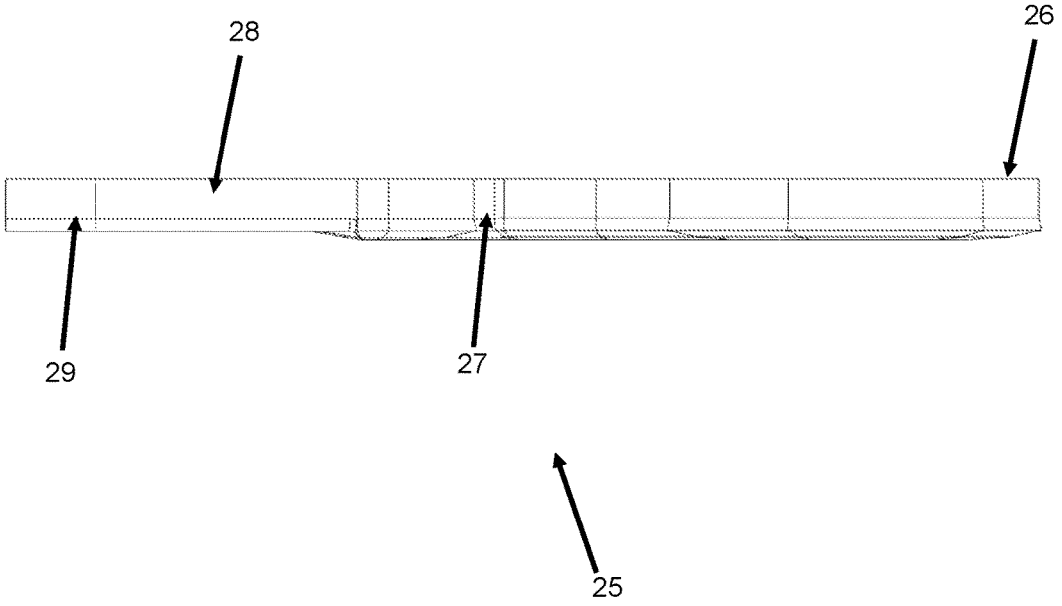
FIG. 35 illustrates of a medial view of the right sole in a neutral position.
Figure 36:
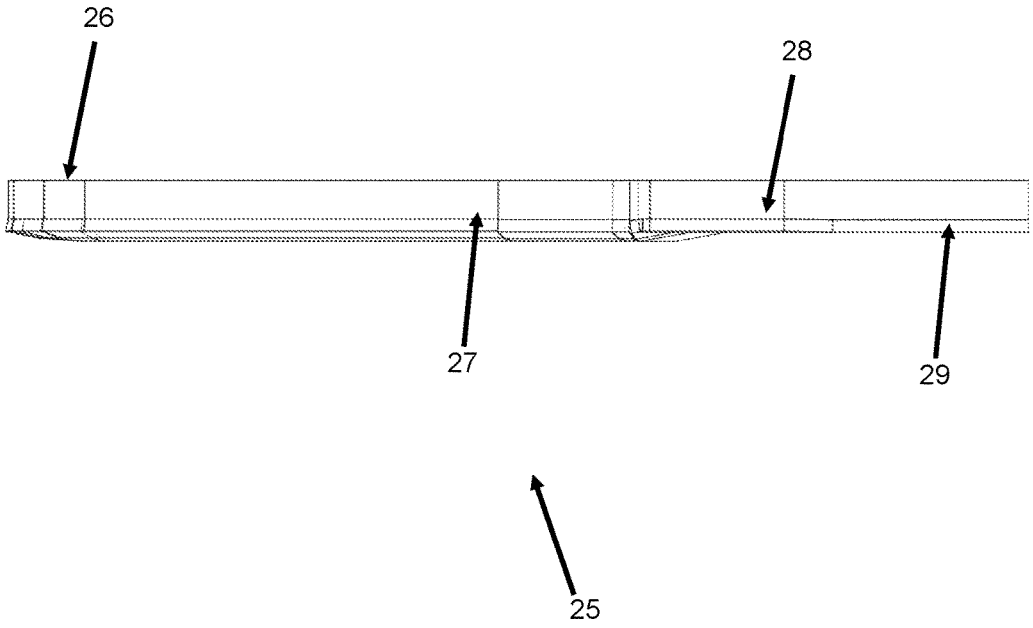
FIG. 36 illustrates of a lateral view of the right sole in a neutral position.
Figure 37:
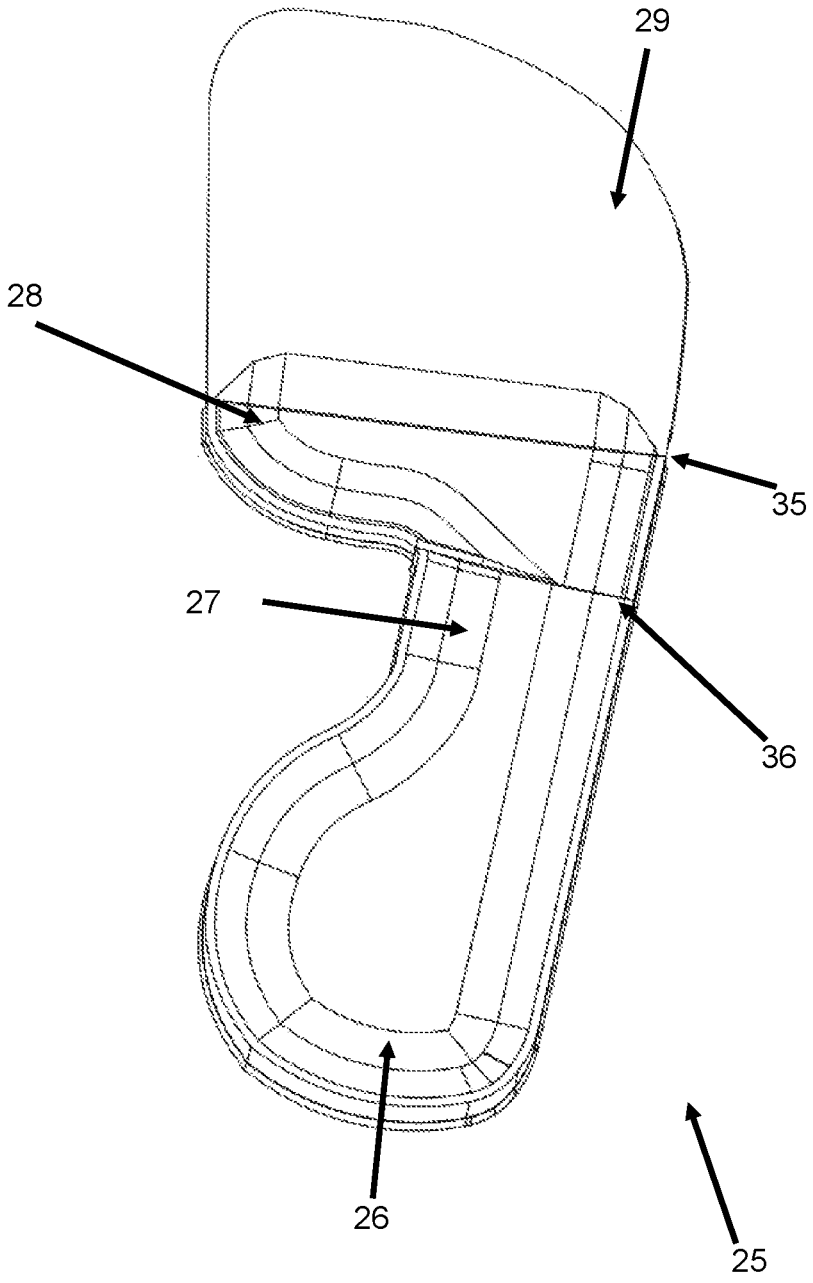
FIG. 37 illustrates of a top view of the right sole in a partially extended position of approximately 22 degrees.
Figure 38:
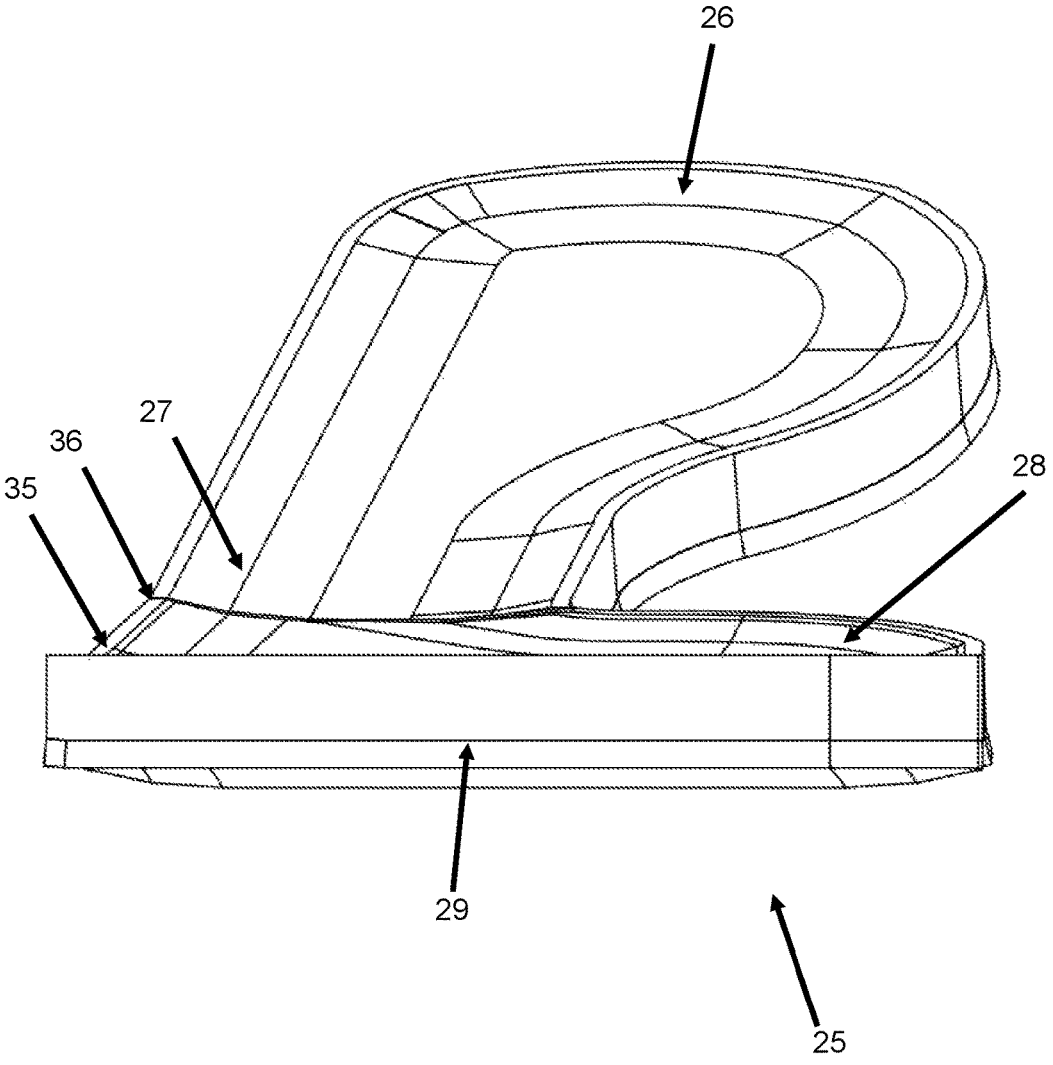
FIG. 38 illustrates of a front view of the right sole in a partially extended position of approximately 22 degrees.
Figure 39:
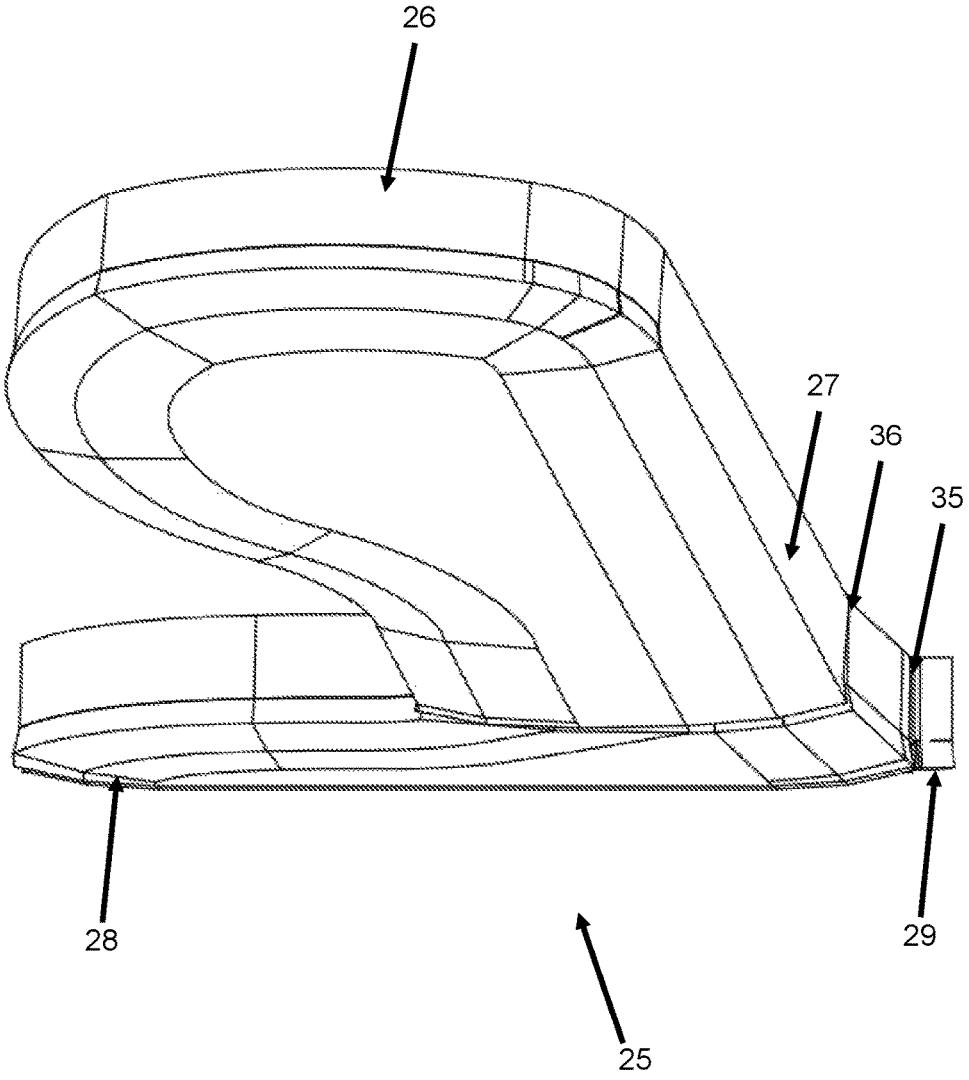
FIG. 39 illustrates of a rear view of the right sole in a partially extended position of approximately 22 degrees.
Figure 40:
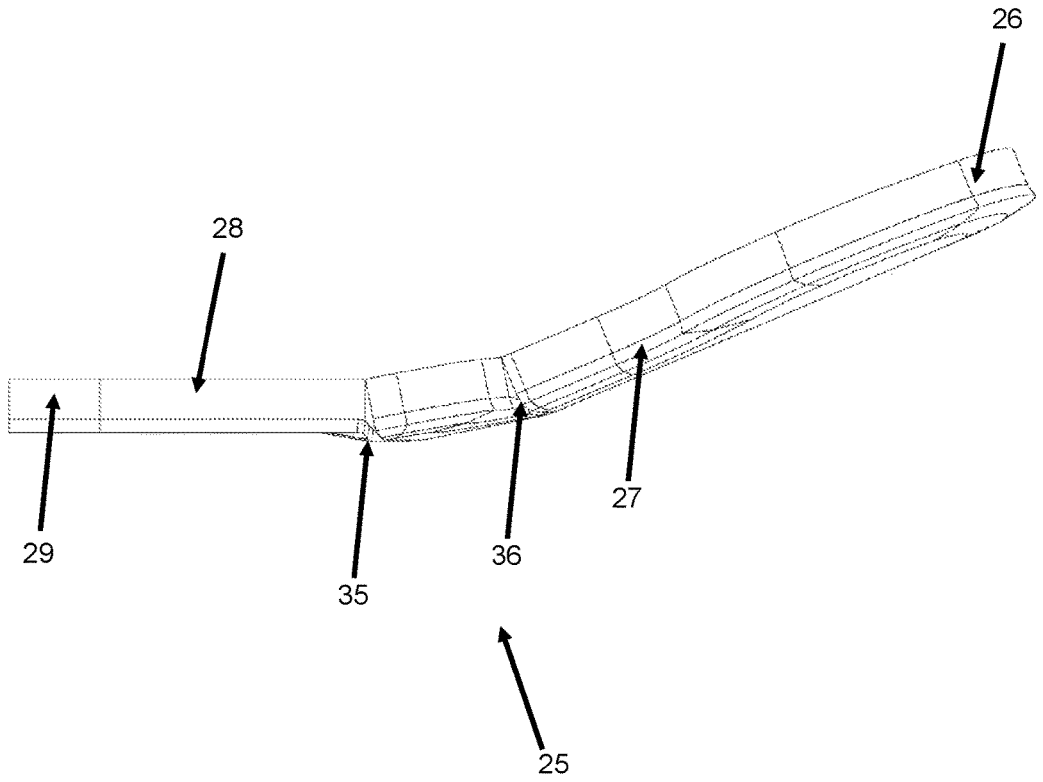
FIG. 40 illustrates of a medial view of the right sole in a partially extended position of approximately 22 degrees.
Figure 41:
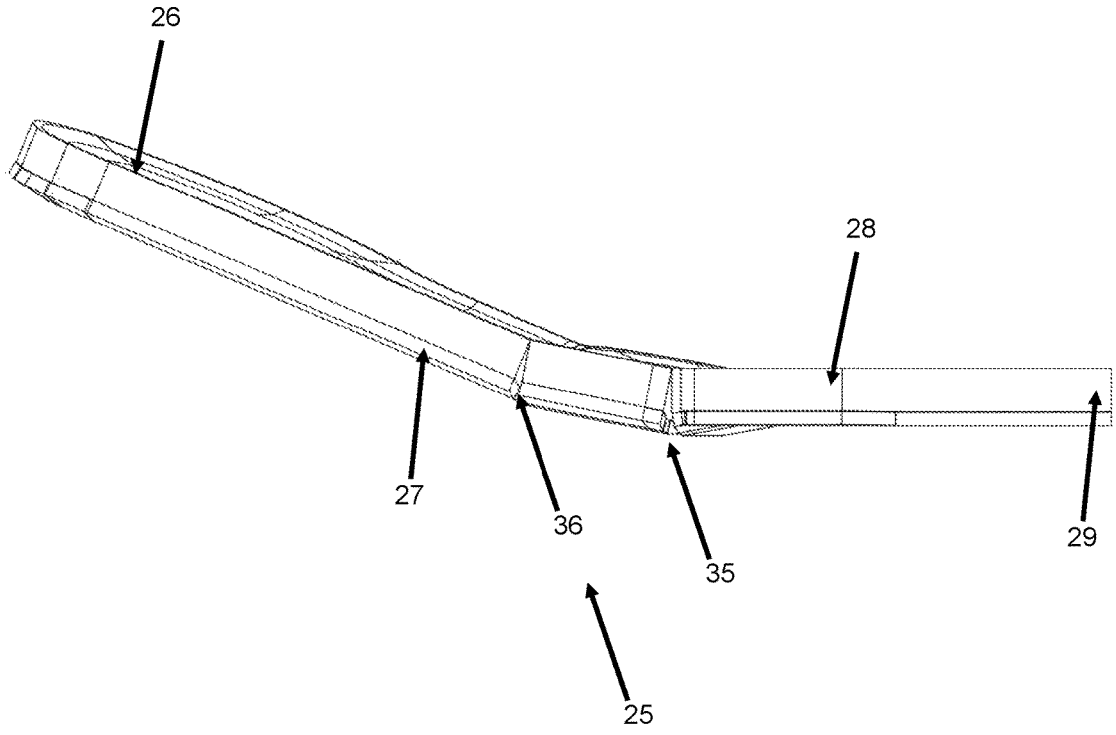
FIG. 41 illustrates of a lateral view of the right sole in a partially extended position of approximately 22 degrees.
Figure 42:
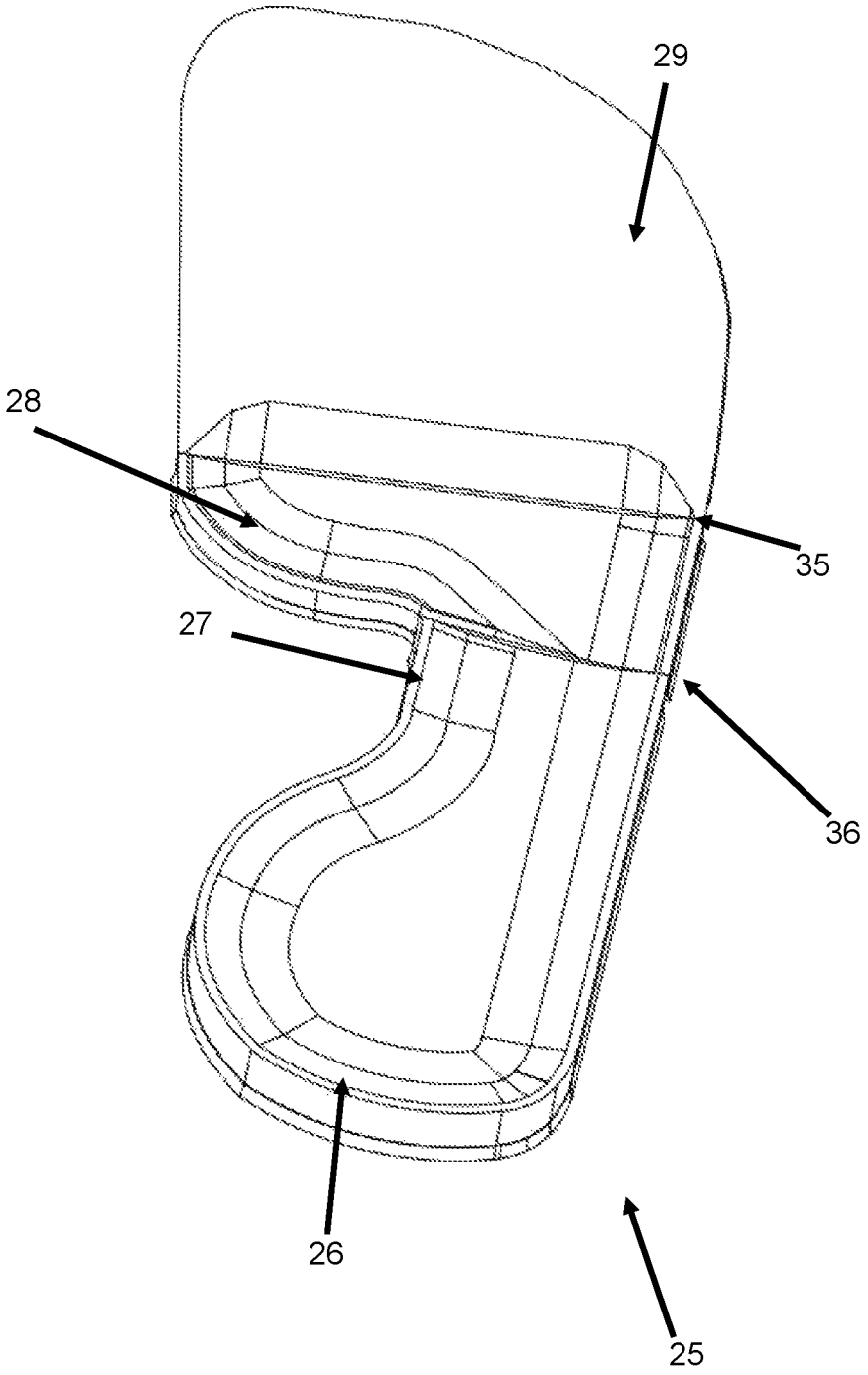
FIG. 42 illustrates of a top view of the right sole in a fully extended position of approximately 45 degrees.
Figure 43:
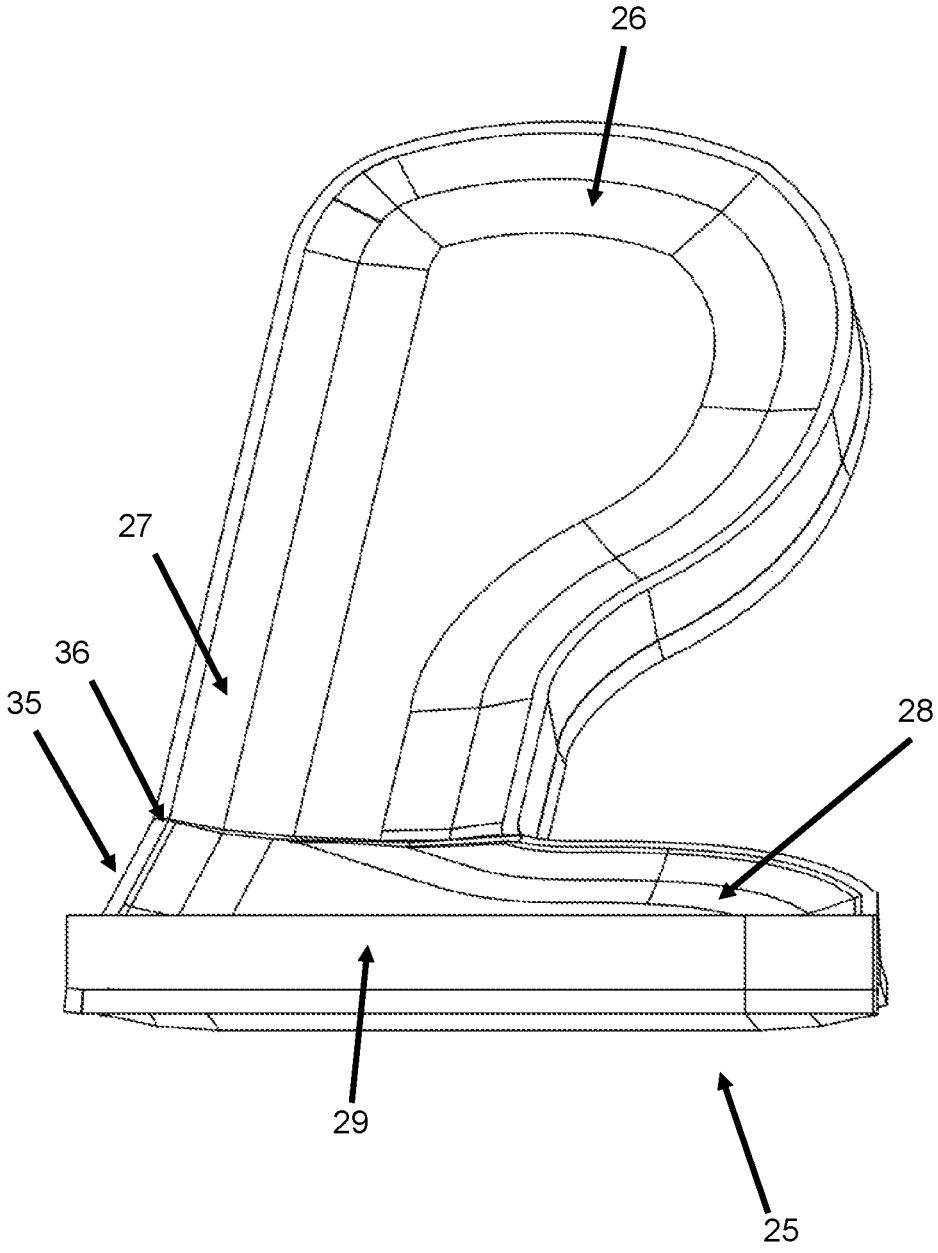
FIG. 43 illustrates of a front view of the right in a fully extended position of approximately 45 degrees.
Figure 44:
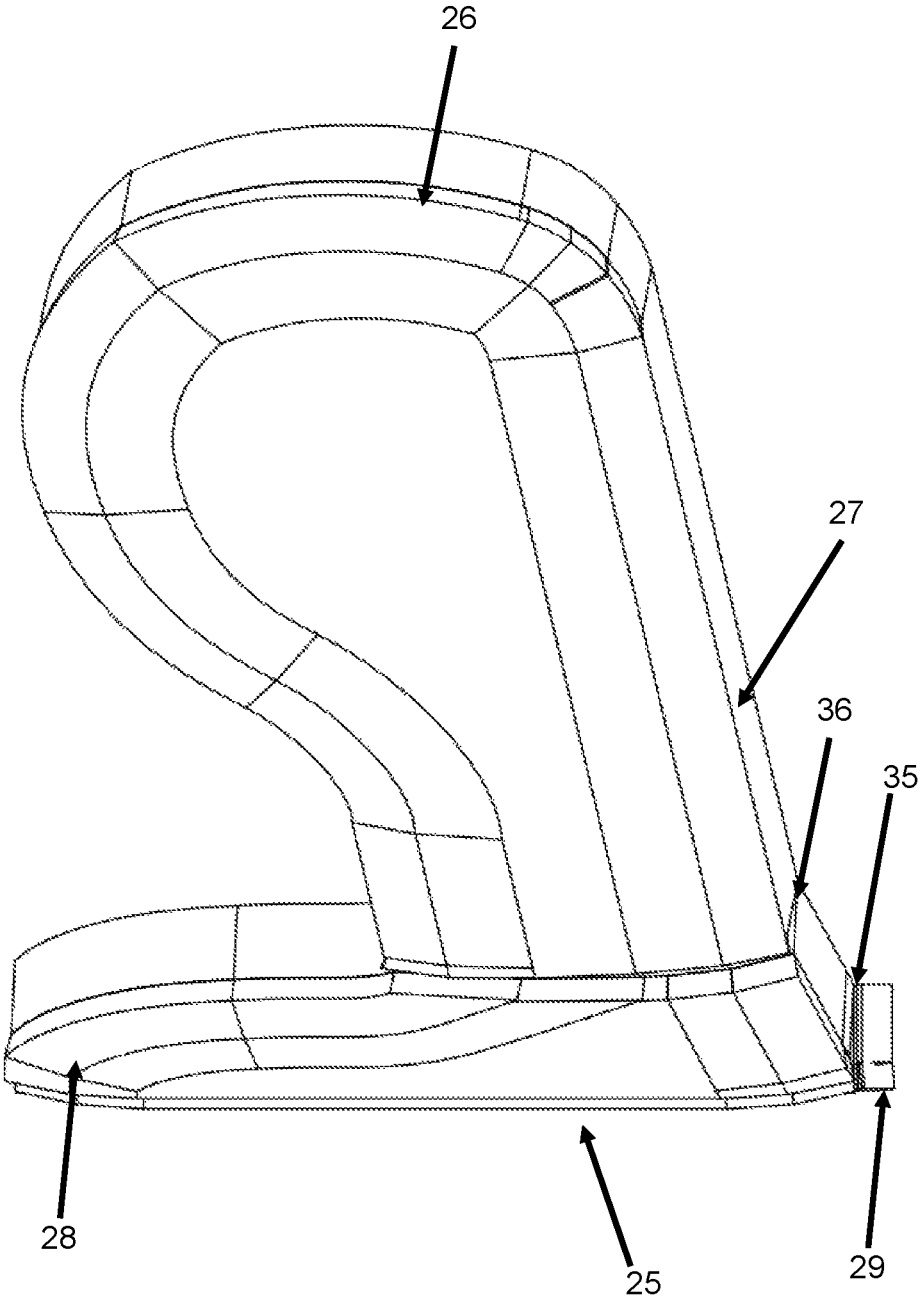
FIG. 44 illustrates of a rear view of the right sole in a fully extended position of approximately 45 degrees.
Figure 45:
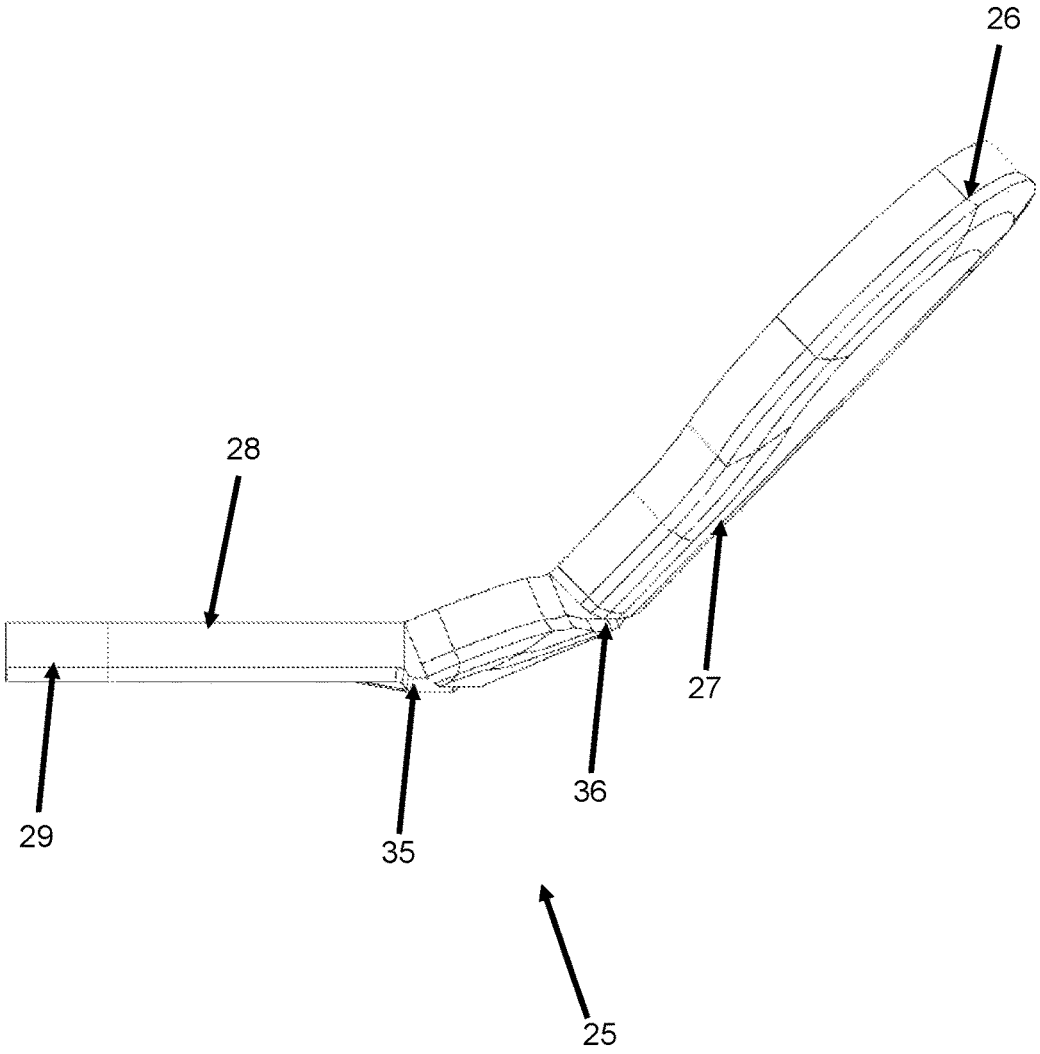
FIG. 45 illustrates of a medial view of the right sole in a fully extended position of approximately 45 degrees.
Figure 46:
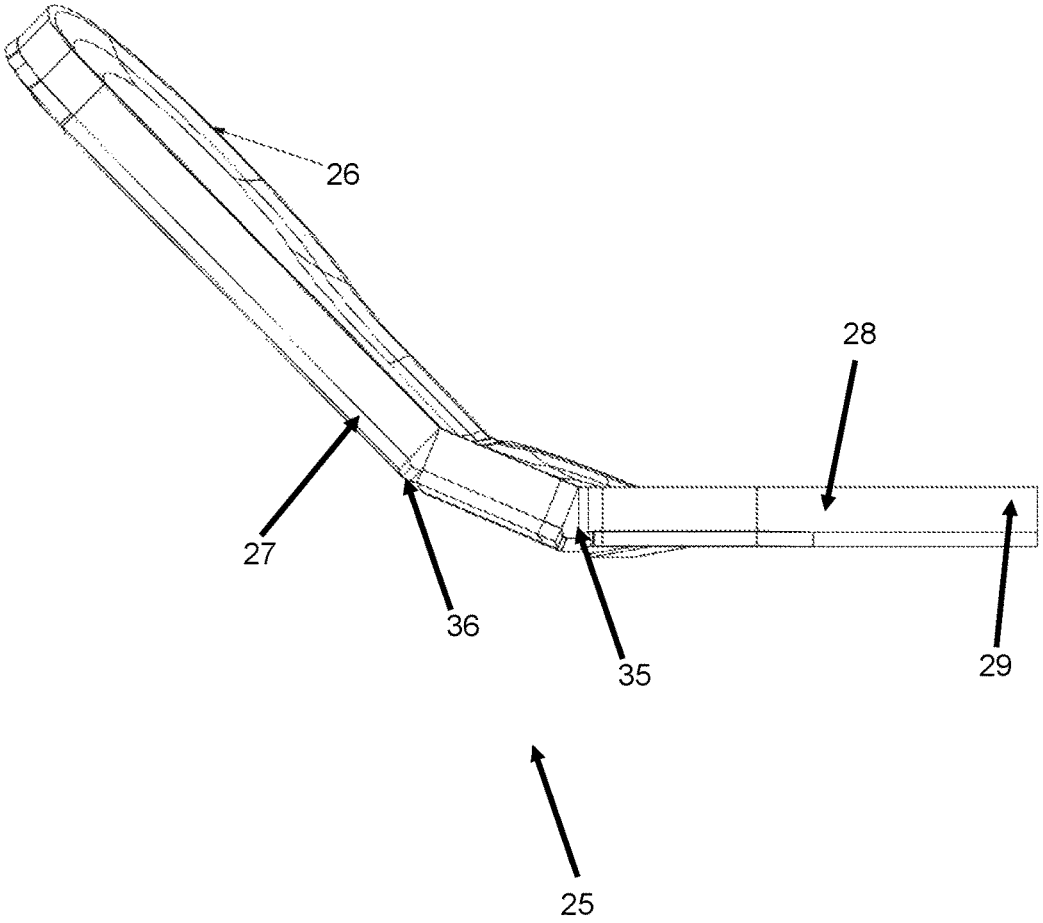
FIG. 46 illustrates of a lateral view of the right sole in a fully extended position of approximately 45 degrees.

This process allows the sole material 32 directly above the flexible grooves 33 to be pre-stretched, and have a resting open hinge. This allows the flexible grooves 33 to easily un-hinge with the internal pressure of the foot during the loading response to a neutral position, as illustrated in FIG. 29. This flexibility in the flexible grooves 33 also allows the sole 25 to easily re-hinge with the internal pressure of the foot during the terminal stance to a position of full extension, as illustrated in FIG. 30.

The flexibility of the sole 25 at the metarsophalgeal joints 18 (along with the shape of the midfoot) allows the forefoot section 28 to extend and flex, and therefore to operate independently from the rearfoot heel 26 and midfoot sections 27. This allows the forefoot section 28 to change two planes in relation to the rearfoot. First, the flexibility allows the shoe to hinge and un-hinge at the metarsophalgeal joints. When the foot is in extension, the forefoot section 28 hinges upward from the rearfoot. When the foot is in neutral flexion, the forefoot section 28 un-hinges to be on the same plane as the rearfoot. Second, the flexibility allows the forefoot section to rotate towards and away from the medial plane. When the foot is in extension, the forefoot section 28 rotates towards the medial plane to an everted relationship to the heel section 26. When the foot is in neutral flexion, the forefoot section 28 rotates to be on the same plane as the heel section 26.

The flexibility in the forefoot section 28 (along with the shape of the midfoot) allows natural forefoot extension, which includes an everted forefoot and plantar flexion (hinge) of the metatarsophalangeal joints. This allows the forefoot to extend naturally to the ground without rotating the entire foot inwards. In order for this to occur, the first metatarsophalangeal joint must extend down and come in contact with the ground. The everted forefoot contacting the ground and absorbing contact by un-hinging and inverting to neutral will allow the proper rate of pronation in loading response. This will help to avoid the rotation of the entire foot inward as a way of getting the first metatarsophalangeal joint to the ground. It will allow all three major points of contact to be made between the foot and the ground surface while the heel is in a neutral position. It will prevent the heel from everting and prevent the medial arch from collapsing. In doing so, the correct posture of the foot will occur.

In embodiments of the subject invention, the flexibility between the forefoot section 28 and midfoot section 27 will allow the shoe 24 to be on two separate planes, vertically and horizonally, simultaneously. In embodiments of the subject invention, the vertical planes may vary from zero degrees to 45 degrees hinged. In embodiments of the subject invention, the horizontal planes may vary from ten degrees everted to ten degrees inverted. The extension and flexion of the forefoot section 28 allows the natural cushioning mechanism of the foot when walking and running.

In embodiments of the subject invention, the flexibility between the forefoot section 28 and midfoot section 27 will allow a person with a forefoot varus to have their foot fit naturally within the shoe 24 without forcing the first metatarsophalangeal joint upwards into the varus position.

The modified shoe 24 must allow room and flexibility on the inside third of the forefoot section 28 for the first metatarsophalangeal joint to fully extend (hinged, plantar flexed). This is key to maintaining the foot's natural arch, as well as allowing for an everted forefoot, which controls pronation and supination. Having the foot in a natural position also allows the toes to extend in the shoe.

The modified forefoot section 28 of the shoe 24 comprises a substantially rounded bottom surface on the fifth metatarsophalangeal joint with a central portion, and an external lateral portion. This modified fifth metatarsal allows a person to land on both the central portion and the external lateral portion of the fifth metatarsal at a variety of angles with the ground surface. The angle at which a person naturally should strike his or her fifth metatarsal lateral portion against the ground surface varies from person to person. In embodiments of the subject invention, the angle of contact with the ground surface may vary in a person in their left foot and right foot. In embodiments of the subject invention, the external lateral portion of the fifth metatarsal may comprise angles ranging from 0 to 10 degrees to allow for fifth metatarsal to contact with the ground surface at angles ranging from 0 to 10 degrees.

The modified toe box section 29 of the shoe 24 comprises enough room to comfortably fit all five toes. The toe box section 29 has the same amount of cushioning as the rest of the shoe. The toe box will be contoured naturally around the toes, with the longest point being at the first and second toes, and gradually slanting down to the fifth toe. The shoe of the subject invention avoids the narrower toe box section 29 disclosed by prior art shoes.

The flexibility at the metatarsophalangeal joints allows the toes to angle upwards during extension. However, the toe box section 29 will not be forced up at this angle, as it is in prior footwear. The toes will be able to be relaxed and push firmly against the ground during flexion and static standing position. In prior shoes, the toes push against the insole when standing, but the sole 25 beneath the toes does not come in contact with the ground. In the modified shoe, the toes will come in contact with the inner surface 30, and the outer surface 31 comes in contact with the ground. In this manner, the toes can directly push off of the ground while standing and during mid stance. This will add stability to the foot while a person is in a static standing position.

In further embodiments of the subject invention, the laces will not run down the center top of the shoe, as in prior footwear. The laces will run at an angle along the top of the first metatarsal. This creates the highest point of the shoe along this bone. When the forefoot is extended to the ground, the highest point in the foot is along this bone. When prior shoes are laced tightly, this can force the forefoot into a flat position. In the modified shoe, the laces being in this position will help the foot lie in its natural position.

In some embodiments of the modified shoe 24, a Velcro® strap will start from the center bottom of the midfoot section 27. It will run horizontally across the medial arch 3, and wrap up the medial side of the shoe 24. The strap will end at the top of the exterior of the shoe 24. This is designed to emulate a Navicular sling wrap, a technique often used in physical therapy to support the medial arch. This will provide support to the shoe for the percentage of people who have sustained previous injury, or have a high degree of forefoot varus.

In embodiments of the subject invention, the modified shoe 24 comprises varying widths, as well as lengths for size.

In embodiments of the subject invention, the modified shoe 24 will allow for proper pronation and supination in a high percentage of people. The shoe 24 will not force anyone into a proper gait pattern. A person's biomechanics and muscles are mainly responsible for a person's gait. However, this shoe will not restrict the forefoot from extending and everting.

The many aspects and benefits of the invention are apparent from the detailed description, and thus, it is intended for the following claims to cover such aspects and benefits of the invention, which fall within the scope, and spirit of the invention. In addition, because numerous modifications and variations will be obvious and readily occur to those skilled in the art, the claims should not be construed to limit the invention to the exact construction and operation illustrated and described herein. Accordingly, all suitable modifications and equivalents should be understood to fall within the scope of the invention as claimed here.

What is claimed is:

1. A modified shoe comprising:

a sole, wherein the sole comprises a substantially flat piece comprising a heel portion with a back side, a midfoot portion, a forefoot portion, a toe box portion with a front side, a first side edge, and a second side edge, a first pre-stretched flexible groove extending completely from the first side edge to the second side edge of the sole between the toe box portion and the forefoot portion, wherein the first pre-stretched flexible groove is composed of an elastic compressible material;

a second pre-stretched flexible groove extending completely from the first side edge to the second side edge of the sole within the forefoot portion, wherein the second pre-stretched flexible groove is composed of the elastic compressible material;

a third pre-stretched flexible groove extending completely from the first side edge to the second side edge of the sole between the forefoot portion and the midfoot portion, wherein the third pre-stretched flexible groove is composed of the elastic compressible material;

a fourth pre-stretched flexible groove extending completely from the first side edge to the second side edge of the sole between the midfoot portion and the heel portion, wherein the fourth pre-stretched flexible groove is composed of the elastic compressible material; and a fifth pre-stretched flexible groove extending from the third pre-stretched flexible groove and the fourth pre-stretched flexible groove, wherein the fifth pre-stretched flexible groove is composed of the elastic compressible material;

wherein the heel portion, the midfoot portion, the forefoot portion, and the toe box portion are independently flexible and movable from each other on a horizontal plane, simultaneously, during a natural human gait movement due to the first, second, third, and fourth pre-stretched flexible grooves.

2. A modified shoe comprising:

a sole, wherein the sole comprises a substantially flat piece comprising a heel portion with a back side, a midfoot portion, a forefoot portion, a toe box portion with a front side, a first side edge, and a second side edge, a first pre-stretched flexible groove extending completely from the first side edge to the second side edge of the sole between the toe box portion and the forefoot portion, wherein the first pre-stretched flexible groove is composed of an elastic compressible material;

a second pre-stretched flexible groove extending completely from the first side edge to the second side edge of the sole within the forefoot portion, wherein the second pre-stretched flexible groove is composed of the elastic compressible material;

a third pre-stretched flexible groove extending completely from the first side edge to the second side edge of the sole between the forefoot portion and the midfoot portion, wherein the third pre-stretched flexible groove is composed of the elastic compressible material;

a fourth pre-stretched flexible groove extending completely from the first side edge to the second side edge of the sole between the midfoot portion and the heel portion, wherein the fourth pre-stretched flexible groove is composed of the elastic compressible material; and a fifth pre-stretched flexible groove extending from the third pre-stretched flexible groove and the fourth pre-stretched flexible groove, wherein the fifth pre-stretched flexible groove is composed of the elastic compressible material; wherein the heel portion, the midfoot portion, the forefoot portion, and the toe box portion are independently flexible and movable from each other on a horizontal plane, simultaneously, during a natural human gait movement due to the first, second, third, and fourth pre-stretched flexible grooves; and further wherein during the natural human gait movement, the shoe is configured to permit a wearer's foot to land in the middle to lateral side of the heel portion of the sole in an inverted heel position, wherein the forefoot portion of the sole inverts and flexes upward to a neutral relation with the heel portion of the sole and with the toe box of the sole coming in contact with the ground, the forefoot portion of the sole everts again while maintaining ground contact as the heel portion of the sole lifts off the ground and inverts.

3. The modified shoe of claim 1, wherein the sole comprises a firm rubber or plastic material.

4. The modified shoe of claim 1, wherein the first side edge proximate to the heel portion is configured to be positioned on a medial side of a foot of a wearer and the second side edge proximate to the heel portion is configured to be positioned on a lateral side of the foot of the wearer, wherein the first side edge and the second side edge proximate to the heel portion each raise up to a maximum of 10 degree from a substantially flat surface of a center portion of the heel portion.

* * * * *